US005775866A

United States Patent [19]

Tax et al.

[11] Patent Number: 5,775,866

[45] Date of Patent: Jul. 7, 1998

[54] CARGO LOADING CRANE

[75] Inventors: Hans Tax; Dieter Bauer, both of München; Klaus Hösler, Eichenau, all of Germany

[73] Assignee: Tax Ingenieurgesellschaft mbH, Munich, Germany

[21] Appl. No.: 737,711

[22] PCT Filed: May 18, 1995

[86] PCT No.: PCT/EP95/01907

§ 371 Date: Nov. 6, 1996

§ 102(e) Date: Nov. 6, 1996

[87] PCT Pub. No.: WO95/32146

PCT Pub. Date: Nov. 30, 1995

[30] Foreign Application Priority Data

May 20, 1994 [DE] Germany ..... 44 17 841.7

[51] Int. Cl.[6] ..... B66C 5/02

[52] U.S. Cl. ..... 414/140.3; 414/141.3; 414/141.4; 212/316; 212/318; 212/325

[58] Field of Search ..... 414/139.4, 139.9, 414/140.3, 141.3, 141.4; 212/316, 325, 324, 318

[56] References Cited

U.S. PATENT DOCUMENTS

| | | | |
|---|---|---|---|
| 3,630,390 | 12/1971 | Tax . | |
| 3,812,987 | 5/1974 | Watatani . | |
| 4,018,349 | 4/1977 | Hupkes | 414/141.3 |
| 4,106,639 | 8/1978 | Montgomery et al. | 414/141.3 |
| 4,175,908 | 11/1979 | Andersson | 414/141.3 |
| 4,858,775 | 8/1989 | Crouch | 212/316 |
| 4,973,219 | 11/1990 | Brickner et al. . | |
| 4,990,046 | 2/1991 | Tax et al. | 414/141.3 |
| 5,039,275 | 8/1991 | Ide | 414/141.3 |
| 5,160,012 | 11/1992 | Jonke | 414/139.4 |
| 5,456,560 | 10/1995 | Rudof, III et al. | 414/140.3 |
| 5,505,585 | 4/1996 | Hubbard | 414/139.4 |
| 5,511,923 | 4/1996 | Dunstan | 414/139.9 |
| 5,515,982 | 5/1996 | Hasegawa et al. | 414/140.3 |
| 5,538,382 | 7/1996 | Hasegawa et al. | 414/141.3 |
| 5,570,986 | 11/1996 | Hasegawa et al. | 414/140.3 |
| 5,603,598 | 2/1997 | Hasegawa et al. | 212/325 |

FOREIGN PATENT DOCUMENTS

| | | |
|---|---|---|
| 0281181 | 9/1988 | European Pat. Off. . |
| 0303884 | 2/1989 | European Pat. Off. . |
| 0474411A1 | 2/1992 | European Pat. Off. . |
| 2283852 | 4/1976 | France . |
| 3837726 | 5/1990 | Germany . |
| 317995 | of 0000 | Japan . |
| 1557640 | 10/1977 | United Kingdom . |
| 9420404 | 9/1994 | WIPO . |

*Primary Examiner*—Karen M. Young
*Assistant Examiner*—Douglas Hess
*Attorney, Agent, or Firm*—Baker & Botts L.L.P.

[57] ABSTRACT

A cargo loading crane (10) comprises a crane bridge (16) having two hoist units (26, 28) with hoisting gear (**26*b*, 28*b*) and assigned cargo pick-up devices (26*c*, 28*c*), a transfer unit (32) with at least one cargo pick-up region (32*o*, 32*u*) and a conveyor unit (64). Division of the horizontal transport path between the transfer unit (32) on the one hand and the conveyor unit (64) on the other shortens the duration of the operating cycle for loading and unloading a cargo carrier (18**).

36 Claims, 30 Drawing Sheets

CARGO LOADING CRANE

BACKGROUND OF THE INVENTION

The invention relates to a cargo loading crane, in particular a container loading crane, comprising a crane bridge extending in a direction of transfer, a first hoist unit, a second hoist unit which is arranged at a distance from the first hoist unit in the direction of transfer, while the first hoist unit and the second hoist unit in each instance have at least one hoisting gear with assigned cargo pick-up means, and a transfer unit arranged between the hoist units, the transfer unit and the hoist units being designed so that cargo can be exchanged between each of the hoist units and the transfer unit.

Such a cargo loading crane is disclosed, for example, in German Patent 19 06 212. The known crane is used for loading and unloading container ships. For unloading a container ship the first hoist unit, the so-called sea or deck crab, lifts a container out of the cargo hold of the vessel and transfers it to a transfer unit (also known as "transfer crab" in technical container parlance) moving on the crane bridge. The transfer crab transfers this container to shore to the second hoist unit, the so-called shore crab, which then sets the container down on the shore, while the transfer crab returns to the first hoist crab.

The duration of the operating cycle for loading and unloading cargo carriers such as, for example, container ships, has hitherto been limited by the two hoist crabs. In loading a container ship, for example, the time required by the deck crab to lower a container, uncouple the cargo pick-up means from this container, transfer the cargo pick-up means to an additional container, couple the cargo pick-up means to this additional container and lift the additional container to the transfer crab was usually longer than the travel time required by the transfer crab from the deck crab to the shore crab and back to the deck crab, including the respective delivery times. However, as a result of continuing technical improvements in hoist crabs as well as in the facilities for guiding a container to be put down and for guiding the cargo pick-up means onto a container to be picked up, these relationships have meanwhile changed to the disadvantage of the transfer crab, which now represents the limiting factor for operating cycle times.

SUMMARY OF THE INVENTION

The object of the invention therefore is to make available a generic cargo loading crane by which operating cycle durations for loading and unloading cargo carriers such as, for example, container ships, can be further reduced.

According to the invention, this object is accomplished in that a conveyor unit is provided in the direction of transfer on the side of the second hoisting means turned away from the first hoist unit, the conveyor unit and the second hoist unit being designed so that cargo can be exchanged between them, and the conveyor unit having at least one delivery/receiving station for cargo.

The conveyor unit, connected before or after the second hoisting means, shortens the transfer path covered by the transfer crab with corresponding shortening of transfer times between deck and shore crabs, as a result of which the operating cycle time of the cargo loading crane is likewise reduced.

To increase the loading and unloading rate in the region of the conveyor unit, it is proposed that the conveyor unit have at least two conveyor tracks with a delivery/receiving station for cargo in each instance. In order to permit side-by-side arrangement of a plurality of cargo loading cranes on the dock, it is further proposed that the at least two conveyor tracks be arranged one above the other.

One conveyor track, for example, may have a conveyor platform which is displaceable on rails extending in the direction of transfer. In a simple and inexpensive-to-manufacture embodiment, the conveyor platform may be formed of a fixed plate which, by means of rollers attached thereto, is movable on the rails.

When at least one of the conveyor tracks is assigned a return track which runs substantially parallel to the conveyor track and serves for the return of conveyor platforms not loaded with cargo, this conveyor track may be equipped with a plurality of conveyor platforms which with the use of the return track circulate cyclicly. This measure allows the conveyor track at the same time to assume, in addition to the conveying function, the function of a buffer as well, for the equalization of conveyor rates of the loading crane and a transport means connected downstream of the delivery/receiving station for cargo. Here a transfer device advantageously may be provided at both ends of the conveyor track and return track in each instance, in order to permit transfer of at least one conveyor platform from the conveyor track to the return track or vice versa.

Owing to the fact that the conveyor unit is arranged above a foundation supporting the cargo loading crane, the ground level, i.e., the foundation supporting the loading crane, can be kept substantially clear and in the event, for example, of disruption or breakdown of the transport device arranged downstream of the cargo delivery/receiving station, used for maintaining an emergency service. In addition, a substantially clear ground level permits performance of a special operation, for example transfer of rush cargo directly by the crane to trucks or the like.

To permit the exchange of cargo between the foundation supporting the crane and the conveyor unit, the crane may, for example, have a supplementary hoist unit. Here the supplementary hoist unit preferably is displaceable in the direction of transfer.

The second hoist unit may be designed displaceable in the direction of transfer. This, if necessary, permits the performance of shifts the width of one or more cargo units, for example in the case of exchange of cargo with the transfer unit, which will be gone into in detail below. Here an especially simple design is obtained when the second hoist unit is displaceable in the direction of transfer on a transport path provided on the crane bridge. Alternatively, however, the second hoist unit may be designed nondisplaceable in the direction of transfer, which permits cost savings, since the second hoist unit does not need a horizontal drive. Fixed arrangement of the second hoist unit on the loading crane makes it possible, if necessary, for the first hoist unit to be moved past the second hoist unit. This is of advantage, for example, in container loading cranes used in shipping ports for removing hatchway covers found in container ships of older design.

In order to prevent wind-caused oscillations of the cargo pick-up means of the second hoist unit before its approach to the conveyor unit and thus permit precise set-down or pick-up of cargo on or from the conveyor unit, it is proposed that guide-in surfaces be arranged on the cargo loading crane for the cargo pick-up means of the second hoist unit. Alternatively or additionally, guide means for the cargo pick-up means of the second hoist unit may be provided on the loading crane, in order substantially to rule out such oscillating motions from the start.

In order to obtain as fast as possible on and off transport of cargo to and from the loading crane, it is proposed that cargo at the delivery/receiving stations be received by a substantially continuously conveying transport device or delivered to a substantially continuously conveying transport device.

In order further to reduce the duration of the operating cycle of the loading crane for loading and unloading cargo carriers, it is provided that the transfer unit has a cargo pick-up region with a cargo-receiving surface and that the cargo pick-up region is assigned an operating device by means of which the cargo pick-up surface, for the exchange of cargo with a front one of the hoist units, is displaceable in a forward direction between a transfer position and a front operating position and, for the exchange of cargo with a rear one of the hoist units, is displaceable in a backward direction between the transfer position and a rear operating position. For a rendezvous maneuver of the transfer unit of the cargo loading crane according to the invention with the front hoist unit, the transfer unit brakes directly beside this hoist unit. Then, if the hoist unit has its hoisting gear raised into the highest position, the operating device moves out and delivers cargo to the hoisting gear or receives cargo from it. After that the operating device moves back into the transfer unit again. The transfer unit subsequently or alternatively simultaneously begins transfer travel to the other hoist unit.

Since only the operating device need be moved out and in here, in the cargo loading crane according to the invention the entire mass of the transfer unit need not be accelerated for delivery or receipt of a cargo. Acceleration of the far smaller mass of the operating device requires less time, which results in shorter operating cycle times and in addition also saves energy which normally would have to be used for accelerating great masses. In addition equipment of the transfer unit with an operating device also has control advantages, since control of the movements of the transfer unit and the hoisting gear of the hoist unit can be effected separately, i.e., independently of one another. As described above, in the case of a conventional cargo loading crane the transfer unit must brake before the respective hoist unit, wait for the cargo pick-up means to be raised completely and, lastly, move on to exactly under the hoist unit, i.e., movement of the transfer unit must be coordinated with movement of the hoisting gear of the hoist unit. According to the invention, the transfer unit moves directly into its end position beside the hoist unit. When the hoisting gear has reached its end position, i.e., its highest position, the operating device is moved out upon a corresponding signal.

A further reduction in operating cycle durations may be obtained in that the transfer unit has at least two cargo pick-up regions with a cargo pick-up surface in each instance, while the cargo pick-up regions are arranged or/and designed so that each of them can cooperate with each of the hoist units for the delivery of cargo from the hoist units to the cargo pick-up surface and for the receipt of cargo by the hoist units from the cargo pick-up surface (below, briefly: cargo exchange with hoist units).

With regard to single-crab cranes, thought has already been given in professional cargo circles to using these in so-called double-cycle operation. This is understood to mean an operation wherein the cargo carrier is simultaneously loaded and unloaded, i.e., an operation wherein a hoist and transfer unit first picks up cargo to be unloaded and unloads it and then immediately picks up cargo to be loaded and conveys it to the cargo carrier.

Owing to the design of the transfer unit according to the invention indicated above, each of the hoist units, upon meeting with the transfer unit, can first deliver to the latter the cargo carried by it in a first one of the pick-up regions and then, independently thereof, take the cargo delivered by the transfer unit from the second pick-up region. Thus the hoist unit as well as the transfer unit come to the meeting point loaded, exchange their cargo there and leave the meeting point loaded again.

In order to be able to carry out the exchange of cargo with both hoist units in less time with this embodiment of the transfer unit having at least two cargo pick-up regions, it is proposed that at least one of the cargo pick-up regions have an operating device by means of which the cargo pick-up surface, for the exchange of cargo with the front one of the hoist units, is displaceable in a forward direction between a transfer position and a front operating position and, for the exchange of cargo with the rear one of the hoist units, is displaceable in a backward direction between the transfer position and a rear operating position. Here the saving of time results from the fact that the shifts required for the exchange of cargo, in which the great mass of one of the units must be moved, can very largely be avoided and only the mass of the particular cargo which is to be moved anyway is moved.

In an embodiment of the operating device, it is proposed for all container loading cranes according to the invention that it have at least one extensible element with a base part fastened to the transfer unit and at least one telescoping part telescoping relative to the base part and displaceable in forward direction and backward direction. Here the cargo pick-up surface may be formed of a surface of the telescoping part turned away from the base part.

In an alternative embodiment the operating device may have a platform which is capable of moving out on rails projecting from the pick-up region in forward direction and backward direction. This embodiment is characterized by especially high stability because of the solidly mounted rails.

In the alternative embodiment of the operating device the platform may be formed of a fixed plate which by means of rollers fastened thereto is capable of moving out on the rails, the cargo pick-up surface being formed of an upper surface of the fixed plate running horizontally. Use of such a platform results in a sturdier and yet compact design of the operating device. However, in principle it is alternatively possible for the platform to be formed of an endless belt, drawn about a guide member, which by means of roller elements is capable of moving out on the rails, while the cargo pick-up surface is formed of an upper part of the endless belt running horizontally.

In order to reduce the number of shifts required for the exchange of cargo as much as possible in the container loading crane operable in double-cycle operation, in a first embodiment of the transfer unit it is provided that the two cargo pick-up regions are arranged one above the other, while at least the lower cargo pick-up region, preferably both cargo pick-up regions, has an operating device.

In an embodiment of the transfer unit alternative thereto, it is provided that the two cargo pick-up surfaces are fixed relative to the associated cargo pick-up regions and, relative to the transfer unit, are capable of jointly swinging about a shaft running substantially horizontally, while maintaining their orientation relative to the transfer unit.

In an additional alternative embodiment of the transfer unit the two cargo pick-up surfaces may be arranged fixed on a substantially horizontal turntable capable of rotation about a shaft running substantially vertically.

Alternatively to a cargo loading crane whose transfer unit has at least two cargo pick-up regions, in a loading crane likewise capable of double-cycle operation the transfer unit may have a cargo pick-up region, while each of the hoist units is assigned at least two hoisting gears with cargo pick-up means assigned in each instance, of which each can cooperate with the cargo pick-up region for the delivery of cargo to the cargo pick-up surface and for the receipt of cargo from the cargo pick-up surface, regardless of whether the other hoisting gear concerned assigned to the same hoist unit has picked up cargo or not. These measures allow each of the hoist units, upon meeting with the transfer unit, first to receive with the now empty cargo pick-up means the cargo from the cargo pick-up region delivered by the latter and then deliver the cargo carried by the other cargo pick-up means into the pick-up region. Thus cargo carriers such as, for example, container ships, can likewise be simultaneously loaded and unloaded in double-cycle operation with the cargo loading crane described above.

In all embodiments of the cargo loading crane described above, the transfer unit may be designed displaceable in the direction of transfer. This has the advantage that the paths to be covered can be distributed among all three units, hoist units and transfer unit, with a corresponding saving of time. Here an especially simple design is obtained when the transfer unit is displaceable in the direction of transfer on a transport track running between the longitudinal ends of the crane bridge.

However, it is alternatively possible for the transfer unit to be designed nondisplaceable in the direction of transfer. In this embodiment the transfer function of the two hoist units is alternatively assumed. This may be done in simple fashion in that the transfer unit is arranged fixed on the crane bridge, for example, at its lower cross arms. Alternatively, however, it is likewise possible for the transfer unit to be arranged movable, on a foundation supporting the loading crane, in a direction running substantially orthogonal to the direction of transfer. In both cases the transfer unit can follow the crane in its movement along the dock, i.e., orthogonal to the direction of crab travel. But even a fixed arrangement on the foundation supporting the loading crane is possible.

According to an additional viewpoint, the invention relates to a method for the transport of cargo between two cargo set-down regions at a distance spaced apart horizontally, wherein the cargo is lifted in both cargo set-down regions and in each instance transported by at least one cargo pick-up and transport system belonging to the first of the cargo set-down regions along a first partial track and by at least one cargo pick-up and transport system belonging to the second of the cargo set-down regions along a second partial track, where delivery from the first cargo pick-up and transport system to the second cargo pick-up and transport system takes place between the two partial tracks with the use of an intermediate carrier system, and where for the transport of cargo along at least one of the first and second partial tracks a supplementary conveyor system is used in addition to the respective cargo pick-up and transport system. In the method according to the invention, use of the supplementary conveyor system shortens the path to be covered for the exchange of cargo by the two cargo pick-up and transport systems and hence also the duration of the operating cycle determining the rate of transport of the method. The hoist units described above, for example, may be used as cargo pick-up and transport systems, the transfer unit described above may be used as an intermediate carrier system, and the conveyor unit described above may be used as a supplementary conveyor system.

DESCRIPTION OF THE DRAWING

The invention is described in detail below by several examples, with the aid of the accompanying drawing, wherein:

FIG. 3*b*, a side view of a telescoping unit of the transfer unit of

FIG. 3*a* moved out in seaward operating position;

FIG. 7*b*, a partial sectional view of the transfer unit of

FIG. 7*a* along the line VII—VII;

DESCRIPTION OF THE EMBODIMENT

Figure 1A:
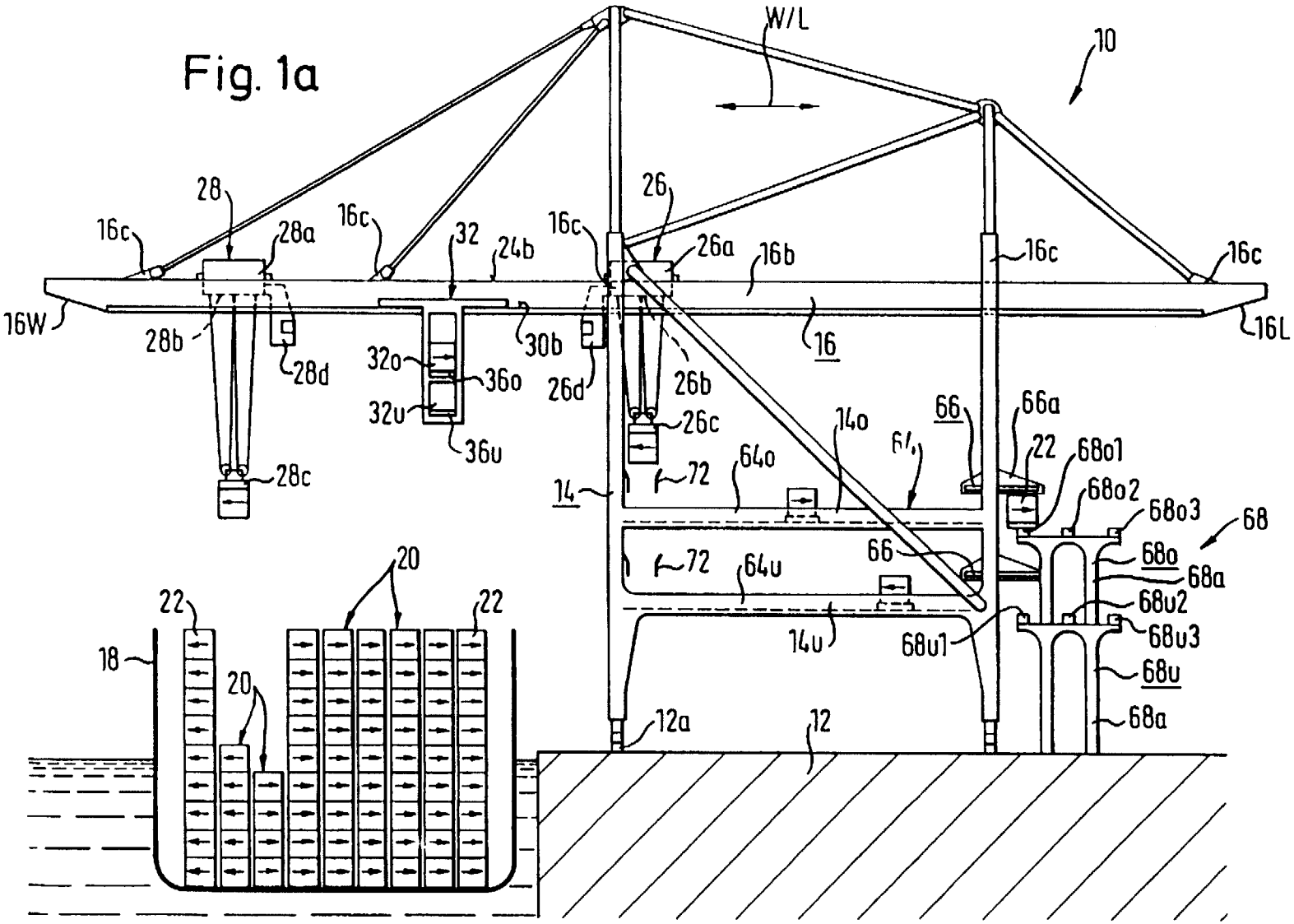
FIG. 1*a* is a side view of a container loading crane according to the invention used in a shipping port, in operating position.

FIG. 1*a* shows a container loading crane, generally labelled 10, for the simultaneous loading and unloading of container cargo ships in double-cycle operation as an example of the cargo loading crane according to the invention.

The container loading crane 10 comprises a gantry 14, movable along a dock 12 on rails 12*a*, on which is mounted a crane bridge 16. A container ship 18, which accommodates containers 22 arranged in stacks 20, is tied up at the dock 12. The narrow end view of the containers 22 can be seen in FIG. 1*a*. Their longitudinal direction extends in the longitudinal direction of the vessel 18 perpendicular to the plane of projection. In FIG. 1*a*, in addition, the containers 22 which are to be unloaded or have already been unloaded from the container ship 18 (below, briefly: unload containers), are identified by a small arrow pointing to the right, while the containers 22 with which the container ship 18 is to be or has already been loaded (below, briefly: load containers) are identified by a small arrow pointing toward the left.

The crane bridge 16 of the container loading crane 10 has a shore-side part 16L and a seaward jib 16W. As represented in particular in FIG. 1*b*, the crane bridge 16 comprises two bridge beams 16*a* and 16*b*, running substantially parallel to one another, which are connected together by a plurality of connecting crosspieces 16*c*. On the upper side of the beams 16*a* and 16*b* there are provided running rails 24*a* and 24*b*, on which a shore-side crab 26 (also below briefly: shore crab 26) and a seaward crab 28 (also below briefly: sea crab 28) are freely movable.

At the outer sides of the beams 16*a* and 16*b* turned away from one another there are provided running rails 30*a* and 30*b* for a transfer crab 32 freely movable on them. The rails 30*a* and 30*b* extend from the seaward end 16W of the crane bridge 16, represented at the left in FIG. 1*a*, to the shore-side end 16L of the crane bridge 16, represented at the right in FIG. 1*a*, in a direction of transfer W/L.

The sea crab 28 comprises a carriage 28*a*, on which a hoisting cable system is arranged. The hoisting cable system, not represented in detail, is connected into cable pulleys of the carriage 28*a* and is driven by a motor. Together the hoisting cable system and motor form a seaward hoisting gear 28*b*. On the hoisting gear 28*b* there is mounted a container pick-up frame 28*c* (also called a spreader in container parlance), which is designed so that it can pick up the container at its four upper corners by means of couplings (not represented in the figures). The movement of the sea crab 28 on the rails 24*a* and 24*b* and the operation of the hoisting gear 28*b* and the spreader 28*c* can be controlled by an operator from a control cabin 28*d* by control lines, not represented.

When the hoisting gear 28*b* is hauled in or released by the motor, the spreader 28*c* rises or drops. When the carriage 28*a*, with motor idle, is moved along the jib 16W, the height of the spreader does not change. The power required for travel along the jib 16W may be supplied to the sea crab 28 by, for example, what are known as cable garlands or a sliding contact rail (neither one represented).

As a rule, the sea crab 28 executes along the jib 16W only those motions which are necessary in order to adapt the horizontal position of the spreader 28*c* supported by the hoisting gear 28*b* to the various stacks 20 of containers, i.e., shifts of normally only one stack width.

The shore crab 26 has a design corresponding to that of the sea crab 28, i.e., the shore crab 26 likewise has a carriage 26*a*, a hoisting gear 26*b* arranged on the latter, with spreader 26*c* and a control cabin 26*d* (see FIG. 1*a*). Operation of the shore crab 26 likewise corresponds essentially to that of the sea crab 28.

In order to keep the hoist path for the hoisting gears 28*b* and 26*b* between container ship 18 and crane bridge 16 and/or between dock 12 and crane bridge 16 as short as possible, the crane bridge 16 is designed displaceable in height relative to the gantry 14.

Figure 1B:
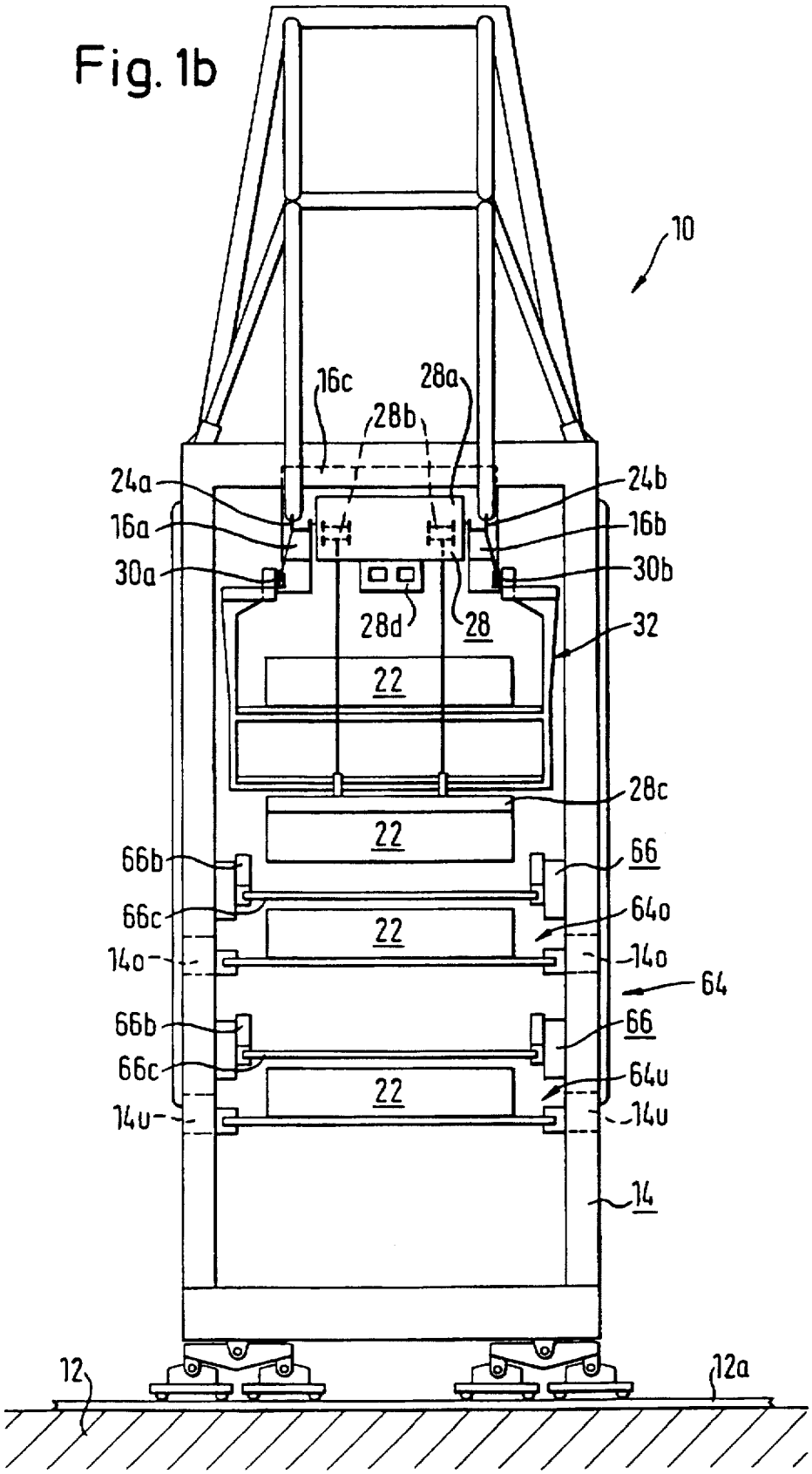
FIG. 1*b*, an end view of the container loading crane of FIG. 1*a* in perspective from the seaward side.

In the embodiment represented in FIGS. 1*a* and 1*b*, horizontal transport of containers 22 along the crane bridge 16 is effected by the transfer crab 32 on the one hand and by a conveyor unit 64 on the other. The conveyor unit 64 comprises an upper conveyor track 640 and a lower conveyor track 64*u*, which are arranged one above the other in order to save space in width.

As represented in particular in FIGS. 1*a* and 1*b*, each conveyor track 64*o*, 64*u*, at its end turned toward the shore-side end 16L of the crane bridge 16, is assigned a delivery device 66. The delivery device 66 comprises a spreader 66*c*, displaceable along a horizontal transport path 66*a*, which can be raised and lowered by means of a short-stroke hoisting gear 66*b*, in order to take containers 22 from an elevated double-deck rail track 68 and set them down on the respective conveyor track 64*o* or 64*u* or, vice versa, take them from a conveyor track 64*o* or 64*u* and set them down on the rail track 68.

The rail track 68 comprises, corresponding to the upper and lower conveyor tracks 64*o* and 64*u*, an upper rail level 68*o* and a lower rail level 68*u* with, in each instance, three rail lines 68*o*1, 68*o*2, 68*o*3 and 68*u*1, 68*u*2, 68*u*3 running substantially orthogonal to the direction of transfer W/L in the region of the container loading crane. By means of a frame structure 68*a*, the rail levels 68*o* and 68*u* are arranged one above the other in two levels, the lower rail level 68*u* alternatively being arranged above the foundation 12 supporting the container loading crane 10.

Due to the arrangement of the lower conveyor track 64*u* as well as the lower rail level 68*u* above the dock 12, the ground level, i.e., the dock 12, remains substantially clear and may be used for the maintenance of emergency service, for example, in case of breakdown of the rail line 68. In addition, the substantially clear ground level permits execution of a special operation, for example, unloading of containers which are to be loaded from the container loading crane directly onto trucks, for example. This will be gone into in detail in connection with the description of FIG. 14. The design and function of the railway 68 will likewise be gone into in detail below.

At the seaward end of the conveyor tracks 64*o* and 64*u* there is in each instance provided a guide device 72, which [serves] to prevent wind-caused oscillations of the spreader 26*c* of the shore crab 26 before approach to the respective conveyor track 64*o* and 64*u*.

With the aid of FIGS. 2*a* and 2*b*, the design and function of the conveyor unit 64 are explained in detail below by the example of the upper conveyor track 64*o*.

The upper conveyor track 64*o* comprises a conveyor platform 64*o*1 which is conveyed in the direction of transfer W/L by means of rollers 64*o*2 in rails 64*o*3. The rollers 64*o*2 are driven by means of a drive 64*o*4, an electric motor, for example. However, in principle a drive employing electromagnetic linear conveying technology or the like may be used. The rails 64*o*3 are formed of two profile beams 64*o*5 having a substantially U-shaped cross section, which are fastened by the base arm of the U shape to horizontal beams 14*o* of the gantry 14, so that the open sides of the U-shape are turned toward one another. In order to prevent the conveyor platform 64*o*1 from falling out of the rails 64*o*3, the beams 64*o*5 are closed off at both ends by means of sealing plates 64*o*6.

The lower conveyor track 64u fastened to horizontal beams 14u of the gantry 14 is designed similar to the upper conveyor track 64o. In particular, the spacing D of the beams 64o5 must be sized so that the spreader 26c of the shore crab 26 can be moved through them, in order to put down a container 22 on the lower conveyor track 64u or to pick up a container 22 from the latter.

Figure 2A:
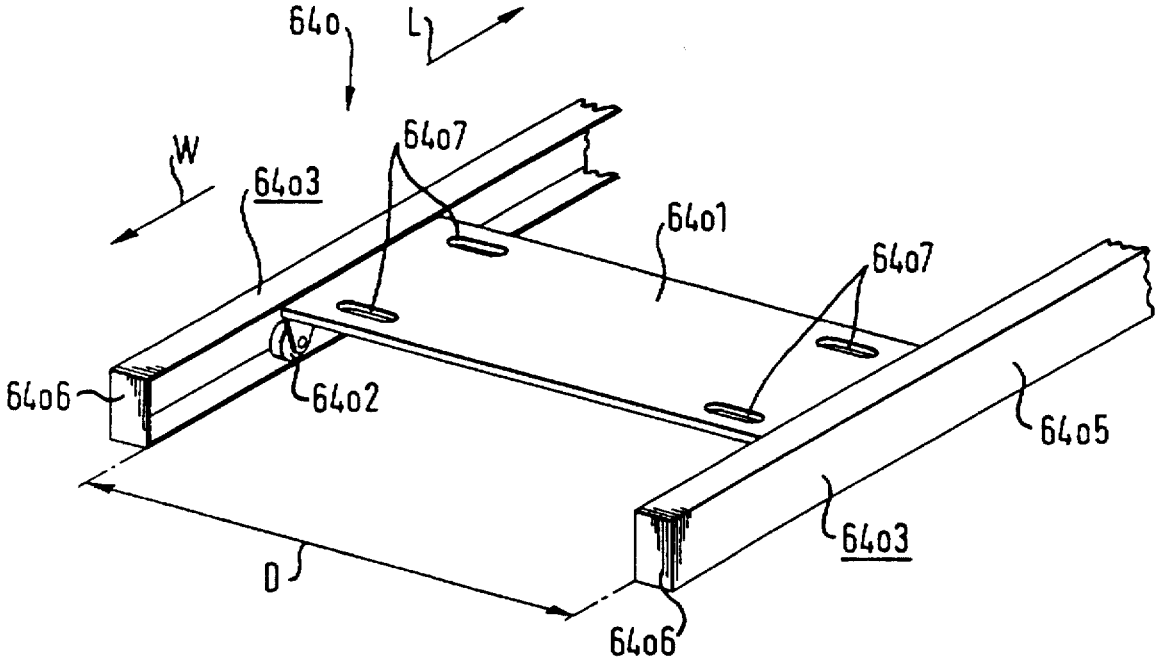
FIG. 2*a*, a partial perspective view of a conveyor track of the container loading crane of FIGS. 1*a* and 1*b*.
Figure 2B:
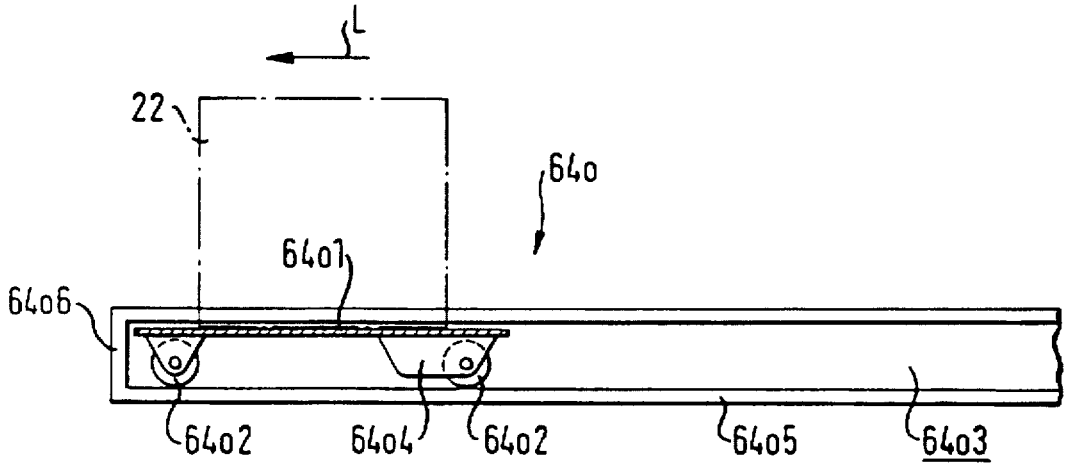
FIG. 2*b*, a side view of the conveyor track of FIG. 2*a*.

In order to be able also to transport with the conveyor unit 64 containers 22 which are equipped with self-locking twist locks (so-called "semi-automatic twist locks"), as are customary, for example, for fastening containers to the deck, the conveyor platforms of the conveyor tracks 64o and 64u are provided with recesses (see for example the recesses 64o7 of the conveyor platform 64o1 of the upper conveyor track 64o, represented in FIG. 2a). The twist locks of a container 22 can be accommodated in these recesses without the container 22 thereby being interlocked with the conveyor platform.

If the travel capability of the shore crab 26 in the direction of transfer W/L is limited, each of the conveyor tracks 64o and 64u may of course alternatively be equipped with more than one conveyor platform (for example 64o1).

It should be stated that, apart from the conveyor means 64 represented in the figures described above, any type of conveyor means which permits an exchange of containers 22 with the shore crab 26 on the one hand and the transport device 68 on the other may be used equally well.

Figure 2C:
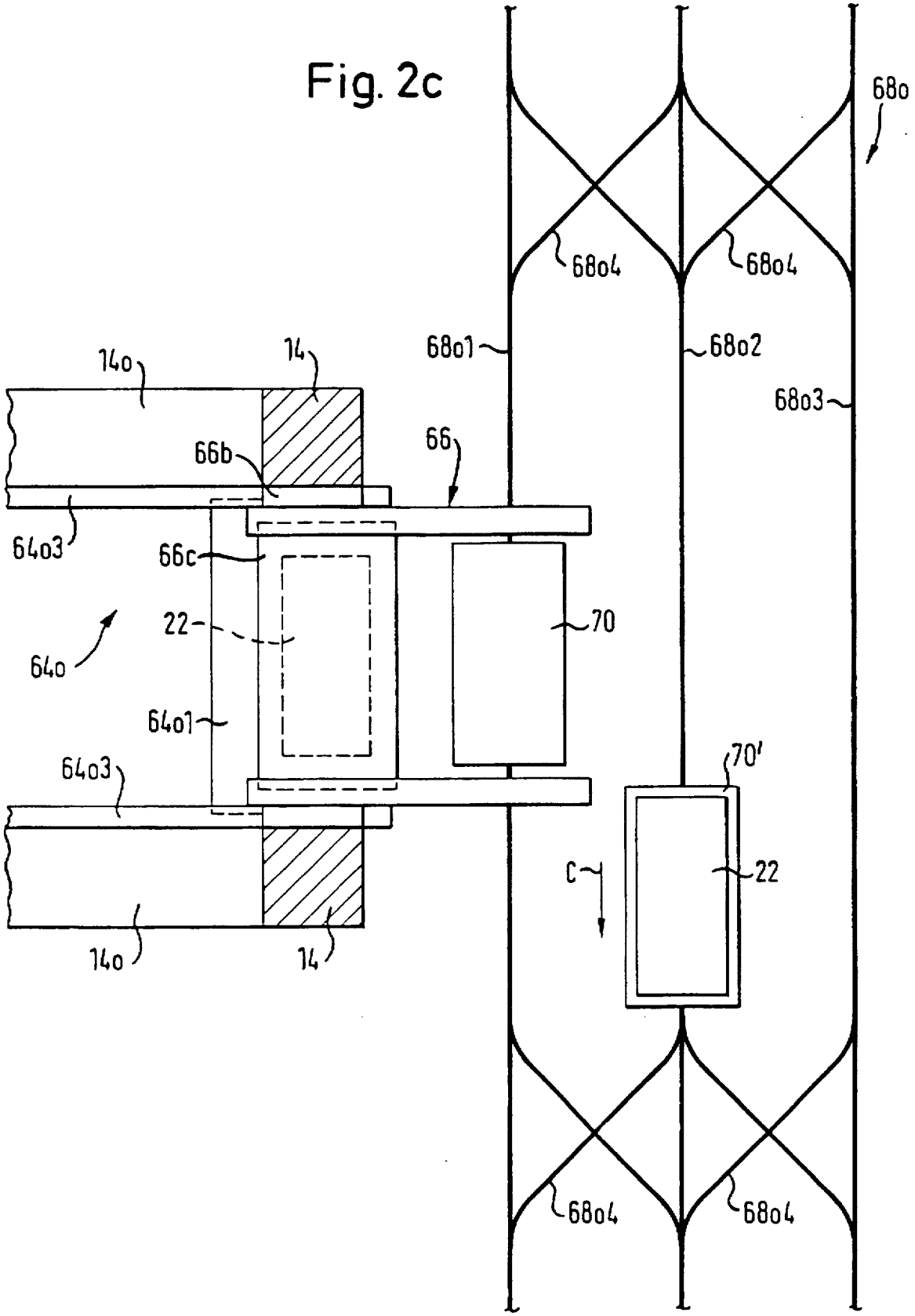
FIG. 2*c*, a rough schematic top view of a container delivery/receiving station of a conveyor track.

A schematic top view of the container delivery/receiving station of the upper conveyor track 64o is represented in FIG. 2c. At the instant of pick-up represented in FIG. 2c, an unload container 22 delivered by the upper conveyor track 64o has been picked up by the spreader 66c of the delivery device 66. The conveyor platform 64o1, of which only the seaward end is visible in FIG. 2c, is again already on the way to the shore crab 26 (see FIG. 1a). A transport car 70, on which the container 22 will be put down by the delivery device 66, is already ready on the rail line 68o1 of the upper rail level 68o.

In addition, another transport car 70', loaded with a container 22, which moves on the center rail line 68o2 in the direction of the arrow C, can be seen in FIG. 2c. Between adjacent rail lines 68o1 and 68o2 and 68o2 and 68o3 there are provided switches 68o4, which permit switching of transport cars 70 from one rail line to another.

The rail lines 68o1 and 68u1 may be designated as, for example, parking tracks, the lines 68o2 and 68u2 as accelerating or hold-up tracks, and the lines 68o3 and 68u3 as transport tracks. On the parking tracks 68o1 and 68u1 the transport cars 70 come to a stop in the region of the delivery devices 66, waiting for loading or unloading of a container 22. For example, after loading with a container 22 the transport car 70 travels onto the parking track 68o1 or 68u1 and then switches to the accelerating track 68o2 or 68u2. There the transport car 70 is accelerated until it has the same speed as the steady stream of transport cars 70 moving on the transport track whereupon, with another track switch, it then inserts itself into this steady stream and is transported, for example, to an intermediate storage location for containers. Delivery of a container 22 from the intermediate storage location to a respective container loading crane is effected in similar fashion, with a corresponding track switch, braking of the transport car 70 on the hold-up track 68o2 or 68u2 and stopping of this transport car on the parking track 68o1 or 68u1.

The rail lines 68o1, 68o2 and 68o3 of the upper rail level 68o are represented schematically in FIG. 2c only as simple solid lines. This is intended to indicate that, in principle, any type of substantially continuously conveying transport device 68 may be used, regardless of which technology is actually used for conveying the container 22 along the tracks and for switching between the tracks. In addition, the number of tracks of the transport device 68 is not limited to the three tracks represented in the drawing. More or fewer tracks may be provided. What is important is only that the individual containers be capable of transport away from or to the container loading crane in substantially steady sequence.

The transport device 68 advantageously comprises, as represented in the examples, at least two transport levels 68o and 68u, of which the one 68o is used for the transport of unload containers and the other 68u for the transport of load containers. This permits simultaneous loading and unloading of the container ship 18 in double-cycle operation. To save space in the width dimension, i.e., along the dock wall, it is additionally advantageous to arrange the two transport levels 68o and 68u one above the other. If the two transport levels are in addition located over the foundation supporting the container loading crane, this ground level may be used for performance of a special operation or for the maintenance of emergency service.

The design of an embodiment of the transfer crab 32 will be explained below with the aid of FIG. 3a.

The transfer crab 32 has two side walls 32a, running vertically, which are connected together by two connecting bases 32b, running horizontally and arranged at a distance apart. The two side walls 32a and the two connecting bases 32b surround a lower container-pick-up region 32u. In addition, the transfer crab 32 comprises an upper container-pick-up region 32o, which is arranged above the upper connecting base 32b and between the side walls 32a. Containers 22 can be picked up in the container-pick-up regions 32u and 32o for transport along the crane bridge 16. At the upper ends of the side walls 32a there are arranged carriages 32c, by means of which the transfer crab 32 can be moved horizontally on the running rails 30a and 30b.

Provided in both pick-up regions 32u and 32o is an operating device 36u and 36o consisting of a plurality of telescoping forks 34. Here the term "operating" means receipt of a container 22 from one of the hoist crabs 26 and 28 and its transfer into one of the pick-up regions 32u or 32o, as well as transfer of a container 22 from one of the pick-up regions 32u or 32o and its transfer to one of the hoist crabs 26 or 28. For exchange of cargo with the sea crab 28 the operating device 36u or 36o can be displaced between a transfer position represented in FIG. 3a and a seaward operating position represented in FIG. 3b, in which the operating device is moved out of the transfer crab 32 in the direction of the arrow W. For exchange of a container with the shore crab 26 the operating device 36u or 36o can be displaced between the transfer position represented in FIG. 3a and a shore-side operating position in which the operating device is moved out of the transfer crab 32 in the direction of the arrow L.

Figure 3A:
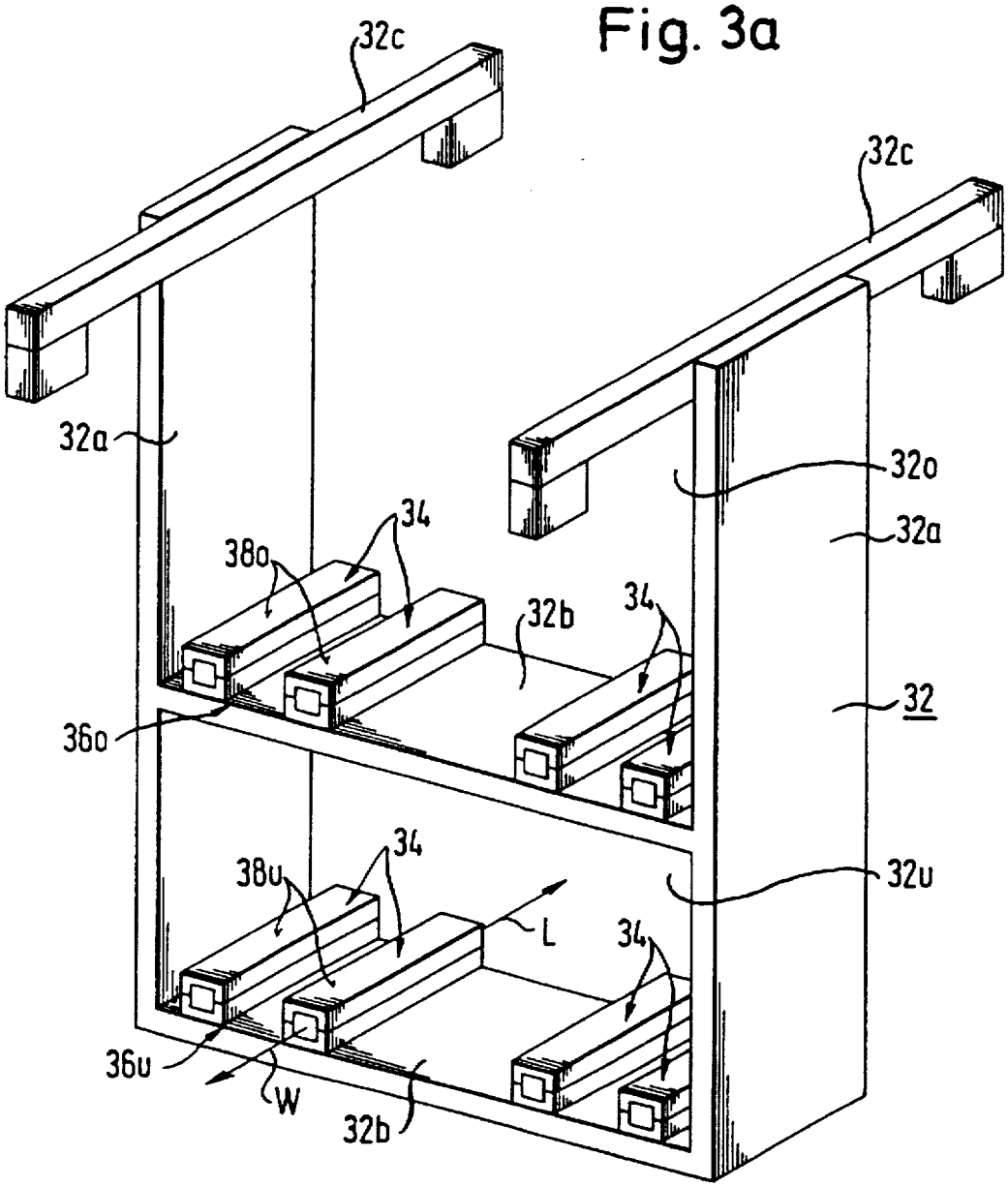
FIG. 3*a*, a perspective view of a first embodiment of a transfer unit.
Figure 3B:
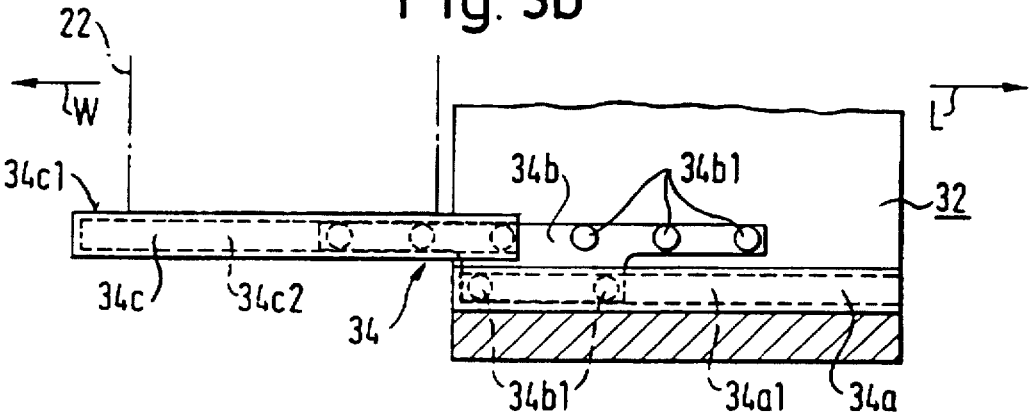

As represented in FIG. 3b, each of the telescoping forks 34 of the operating device 36u or 36o consists of a lower guide rail 34a fastened to the transfer crab, an intermediate element 34b and an upper guide rail 34c. On both sides of the longitudinal direction of the intermediate element 34b are mounted guide rollers 34b 1, which engage in guide grooves 34a 1 and 34c 2 of the guide rails 34a and 34c and with them jointly enable the telescoping forks 34 to telescope. Upper sides 34c 1 of the upper guide rails 34c together form a lower container set-down surface 38u and an upper container set-down surface 380, on each of which a container 22 can be put down.

For the sake of clearer representation, the drive of the telescoping forks 34 is not drawn in in FIGS. 3a and 3b. This drive may be designed in a manner known per se, for example, as a pneumatic or electromotive drive or the like.

For receipt of a container 22 already hoisted by one of the hoist crabs 26 or 28 in the lower pick-up region 32u, for example, the transfer crab 32 first moves into the immediate vicinity of the hoist crab. The telescoping forks 34 of the lower pick-up region 32u are then moved out into the seaward or shore-side operating position, depending upon whether the container 22 is to be received from the sea crab 28 or the shore crab 26. Next, the container 22 is lowered by means of the hoisting gear 26b or 28b of the hoist crab 26 or 28, until its lower edge 22a rests on the container set-down surface 38u or 38o. Lastly, after release and lifting of the spreader 26c or 28c of the hoist crab, the container 22 is conveyed into the pick-up region 32u by movement of the telescoping forks 34 into the transfer position.

Upon delivery of a container 22 to one of the hoist crabs 26 or 28 the steps described above are performed correspondingly in reverse sequence.

As is represented in particular in FIG. 1b, the container set-down surface 38o of the upper pick-up region 32o is arranged lower in vertical direction than the lower edge 22a of a container 22 when the latter is lifted as far as possible by one of the hoist crabs 26 or 28 (in FIG. 1b, by the sea crab 28). It is thus ensured that both pick-up regions 32u and 32o equally can be served by the hoist crabs 26 and 28.

Loading and unloading of the container ship 18 in double-cycle operation is described below with the aid of the schematic representations of FIGS. 9a to 9f.

Figure 9A:
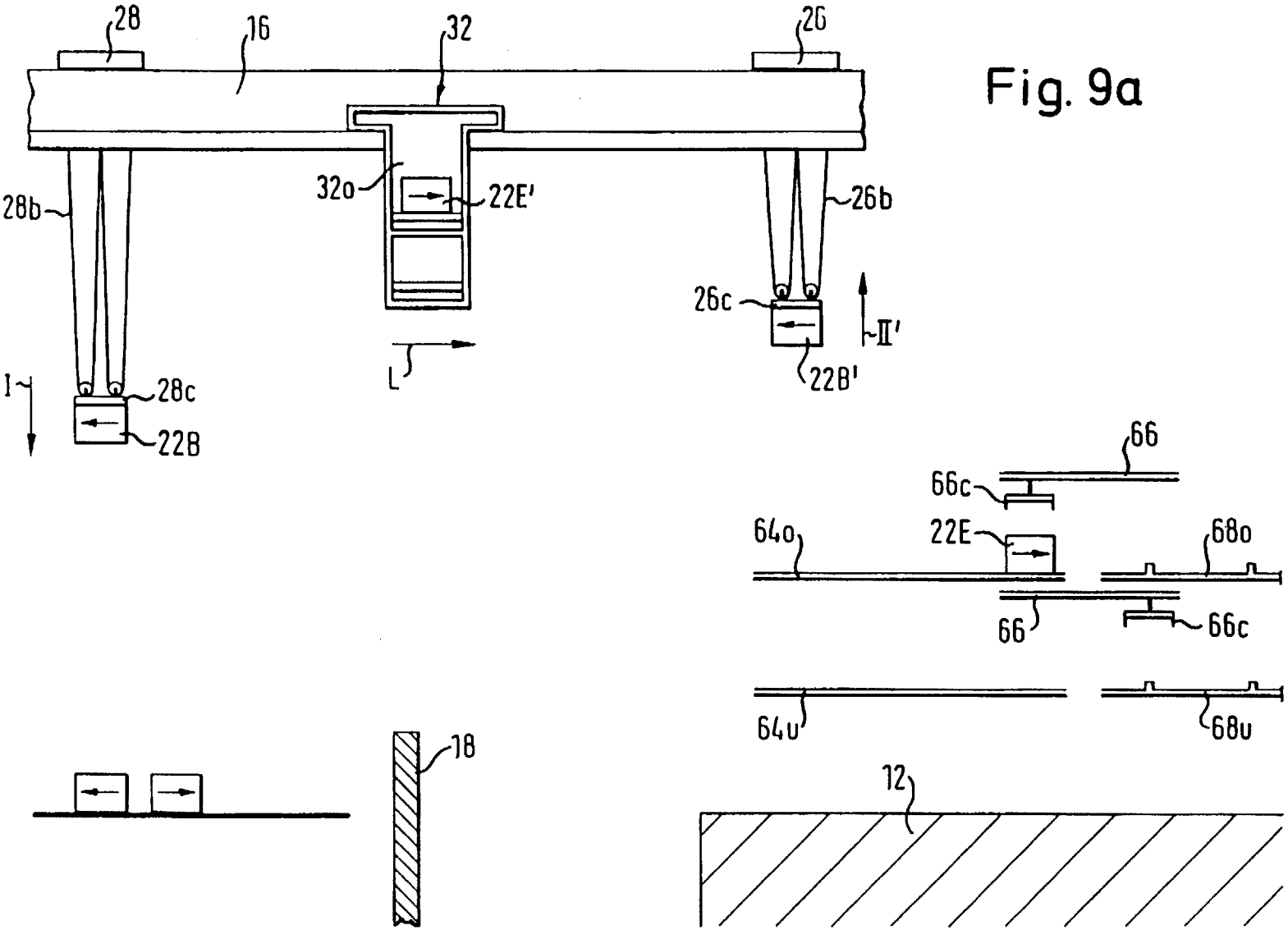
FIGS. 9*a* to 9*f*, rough schematic side views for the explanation of double-cycle operation with the container loading crane of FIG. 1*a*.

Here we start out from a situation as represented in FIG. 9a. The sea crab 28 has just received a load container 22B from the transfer crab 32 and is lowering the container 22B by means of the hoist gear 28b, which is indicated in FIG. 9a by an arrow I. In addition, the transfer crab 32 has received from the sea crab 28 an unload container 22E' in the upper pick-up region 32o and is on shore travel, i.e., is moving with the container 22E' along the crane bridge 16 to the shore crab 26, which is indicated in FIG. 9a by the arrow L.

The shore crab 26 has picked up a load container 22B' from the lower conveyor track 64u and is just lifting it by means of its hoisting gear 26b, which is indicated in FIG. 9a by an arrow II'. Meanwhile an unload container 22E put down in front of the shore crab 26 is already on the shore-side end of the upper conveyor track 64o and can be picked up by the spreader 66c of the delivery device 66.

Figure 9B:
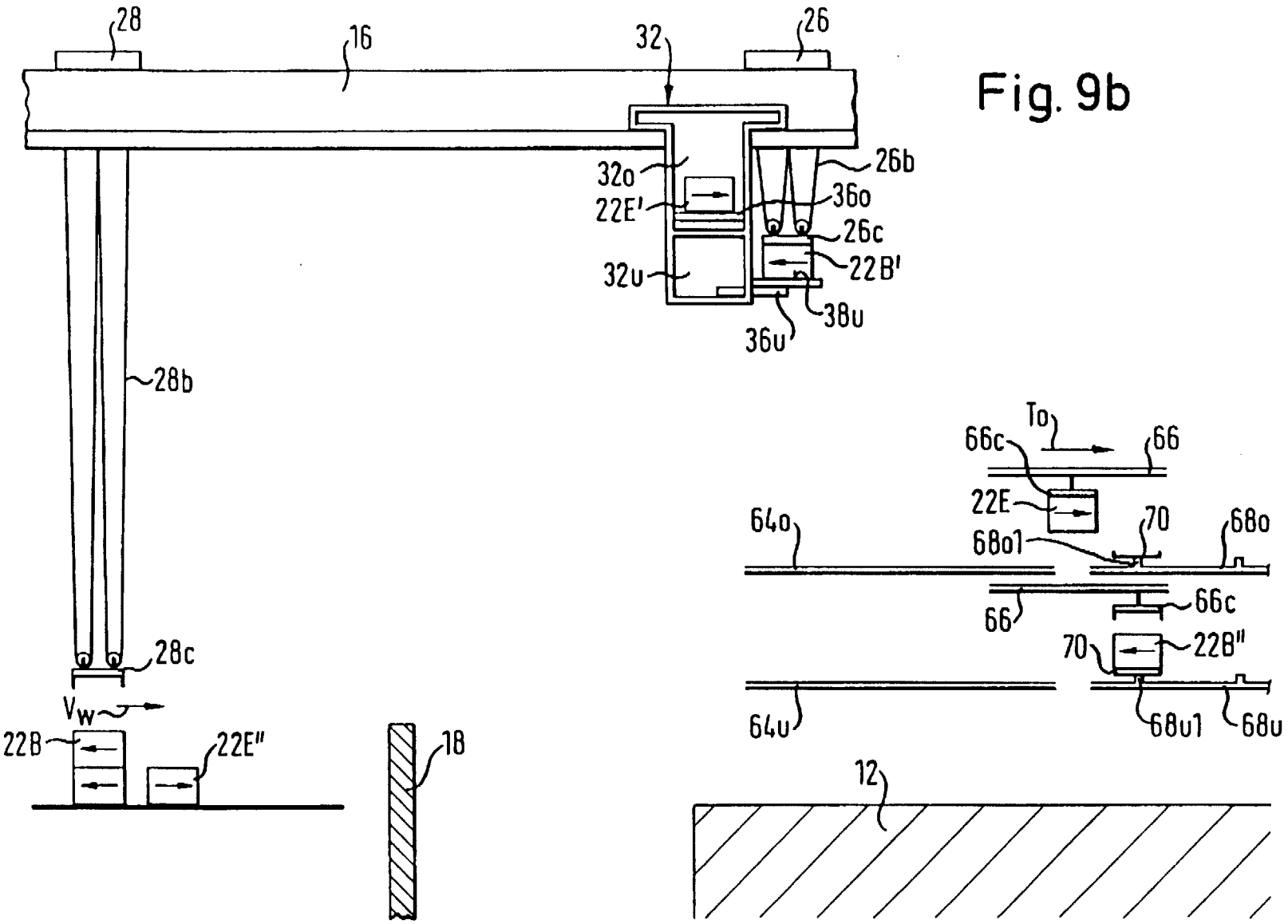

In FIG. 9b the shore crab 26 has lifted the load container 22B' up to a level corresponding to the level of the lower pick-up region 32u of the transfer crab 32. In addition, the transfer crab 32 has been moved directly up to the shore crab 26. Now the lower operating device 36u is moved out on the shore side and the shore crab 26 lowers the load container 22B' until it stands on the lower container set-down surface 38u.

In the meantime the sea crab 28 has loaded the load container 22B onto the container ship 18 and is on a shoreward shift of one stack width (arrow $V_w$ in FIG. 9b), in order to pick up the next unload container 22E" with its spreader 28c.

Meanwhile the unload container 22E has been picked up by the spreader 66c of the delivery device 66 and together with the latter is on the way (arrow To) to the parking track 68o1 of the upper rail level 68o, where a transport car 70 is already waiting for it. In addition, a transport car 70 with an additional load container 22B" has stopped on the parking track 68u1 of the lower rail level 68u.

Figure 9C:
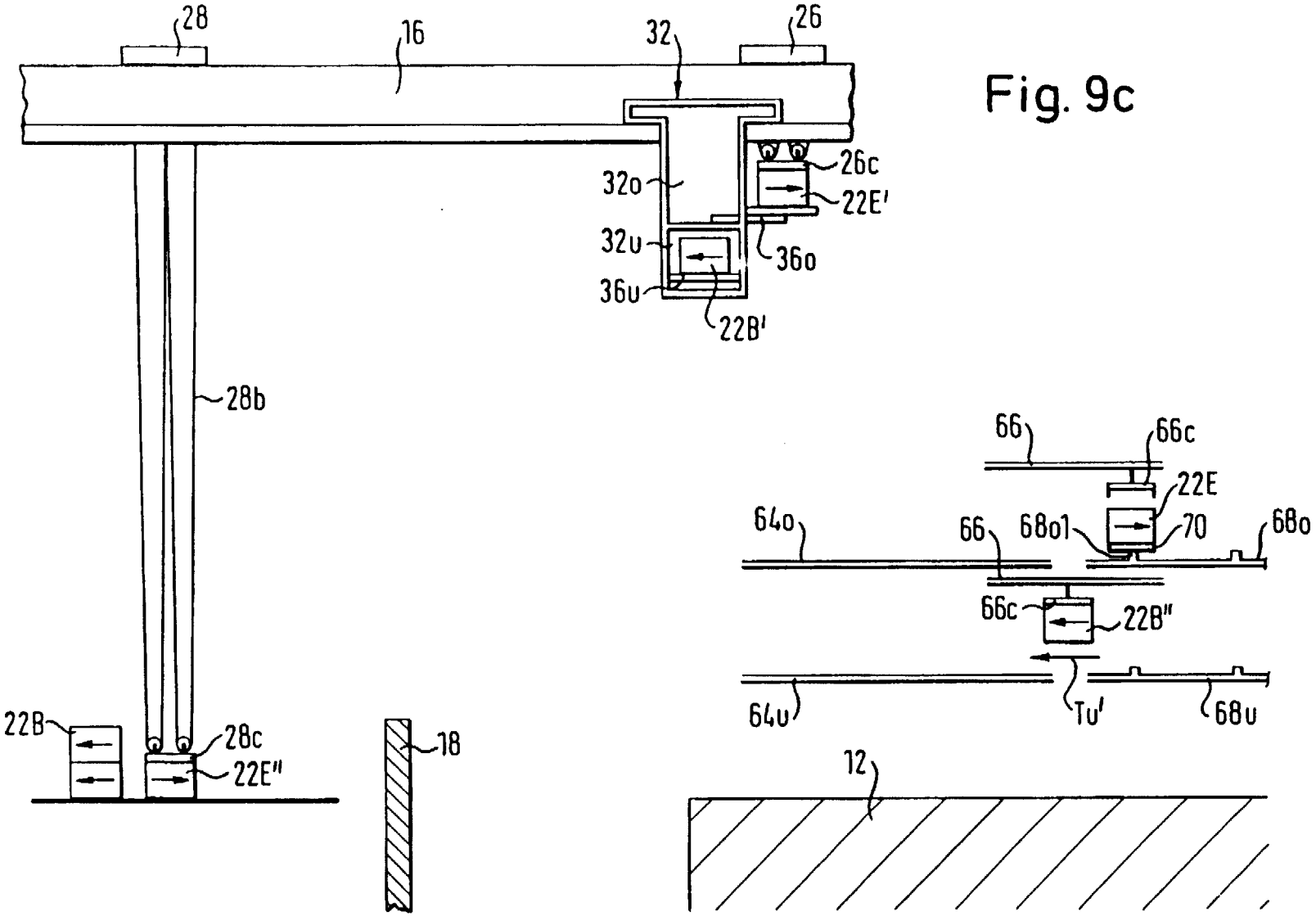

In FIG. 9c the spreader 28c of the sea crab 28 is coupled to the unload container 22E". The spreader 26c of the shore crab 26 is released from the load container 22B' and the load container 22B' is brought by means of the lower operating device 36u into the lower pick-up region 32u of the transfer crab 32. The spreader 26c thereupon is raised as far as possible, the unload container 22E' is moved out of the upper pick-up region 32o by means of the upper operating device 36o and the spreader 26c is coupled to the unload container 22E'. Now the upper operating device 36o is brought in again.

Meanwhile the upper delivery device 66 has set the container 22E down on the transport car waiting on the parking track 68o1 and the lower delivery device 66 with the load container 22B" is on the way to the lower conveyor track 64u (arrow Tu').

Figure 9D:
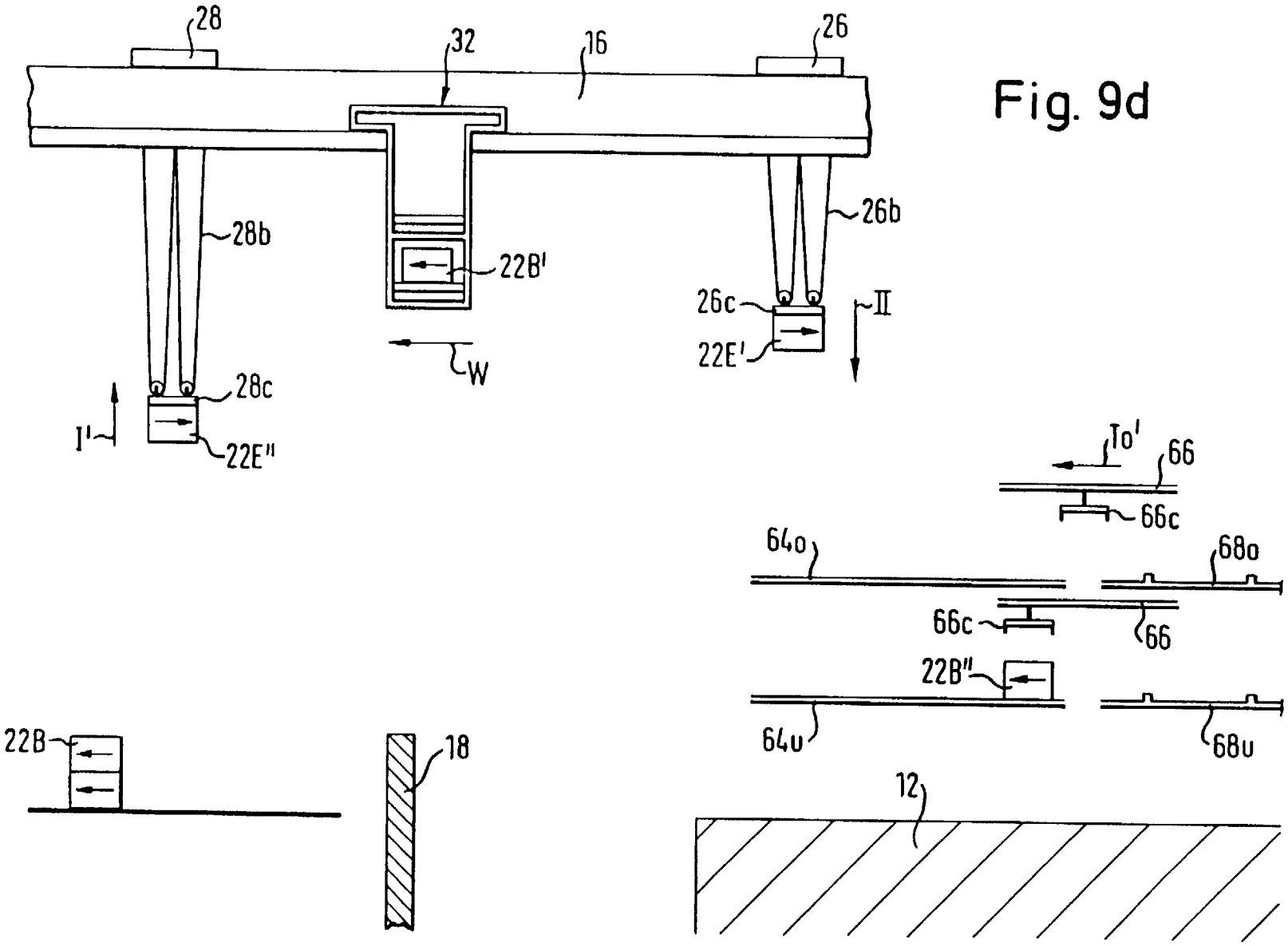

In FIG. 9d, the transfer crab 32 with the load container 22B' is on seaward travel, i.e., it moves with it along the crane bridge 16 to the sea crab 28, which is indicated in FIG. 9d by the arrow W. At the same time the shore crab 26 lowers the unload container 22E' by means of its hoisting gear 26b (arrow II). Meanwhile the sea crab 28 lifts the unload container 22E" by means of its hoisting gear 26b (arrow I').

The spreader 66c of the upper delivery device 66 is on the way back to the upper conveyor track 64o (arrow To'), in order to wait there for the next unload container. In addition, the lower delivery device 66 has put the load container 22B" down on the lower conveyor track 64u.

Figure 9E:
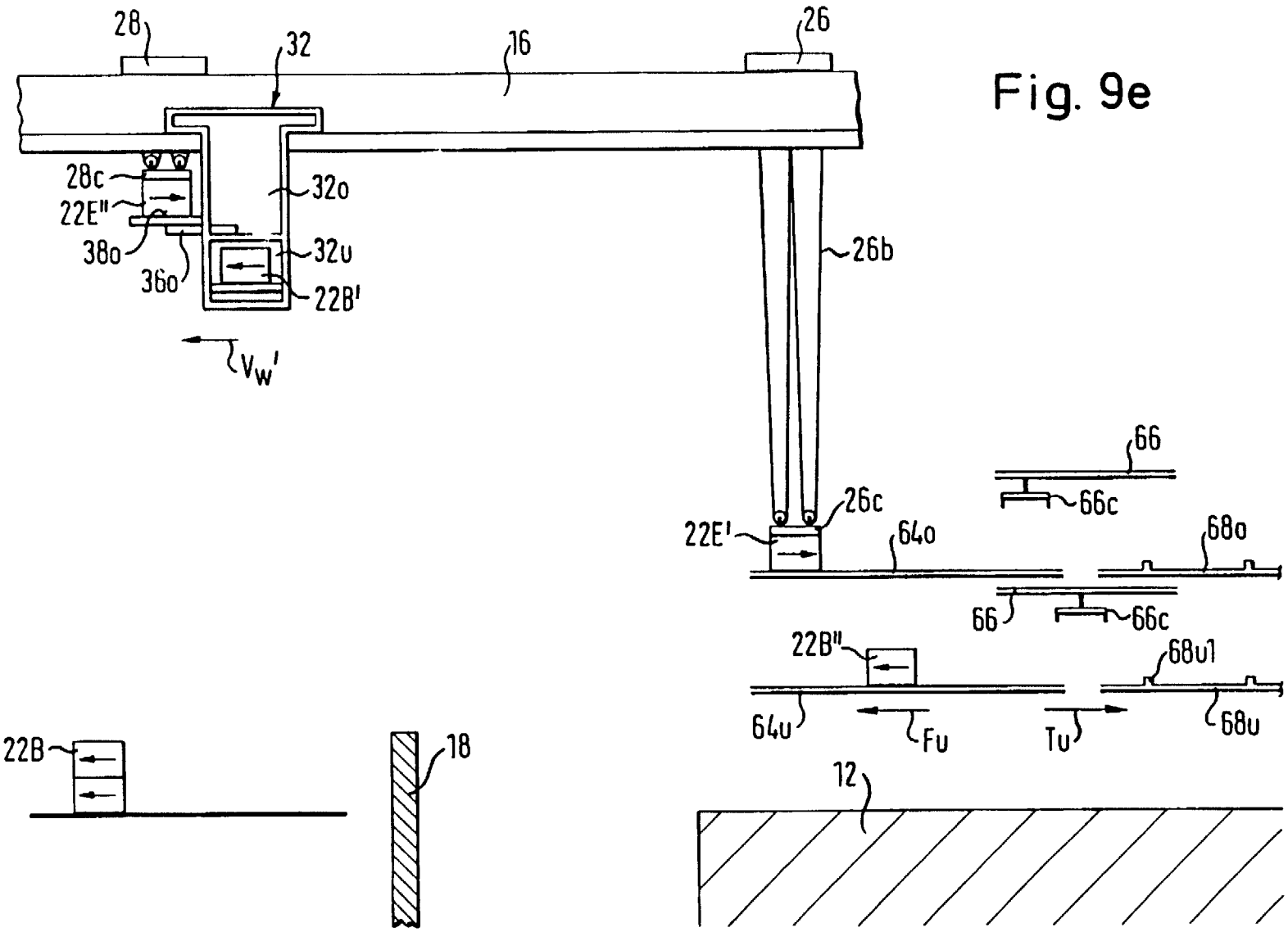

In FIG. 9e, the sea crab 28 has lifted the unload container 22E" as far as possible, i.e., to a height corresponding to the upper pick-up region 32o of the transfer crab 32. In addition, the transfer crab 32 has been moved directly up to the sea crab 28. The upper operating device 36o is now moved out on the seaward side and the sea crab 28 lowers the unload container 22E" until it stands on the upper container set-down surface 38o. Then the sea crab 28 and transfer crab 32 begin a common seaward shift of one stack width, which is indicated in FIG. 9e by an arrow $V_w$.. For the execution of this shift it is of advantage if the transfer crab 32 can be detachably interlocked with the sea crab 28, so that relative motion of the two crabs 28 and 32 during the shift can be prevented. Such interlocking may alternatively be provided between the shore crab 26 and the transfer crab 32.

The shore crab 26 has placed the unload container 22E' on the upper conveyor means 64o and uncoupled its spreader 26c from the latter.

In

FIG. 9e the load container 22B" is conveyed toward the left (arrow Fu) by the lower conveyor means 64u for delivery to the shore crab 26, and the spreader 66c of the lower delivery means 66 is on the way back to the parking track 68u1 of the lower rail level 68u (arrow Tu), in order to wait there for the next load container.

Figure 9F:
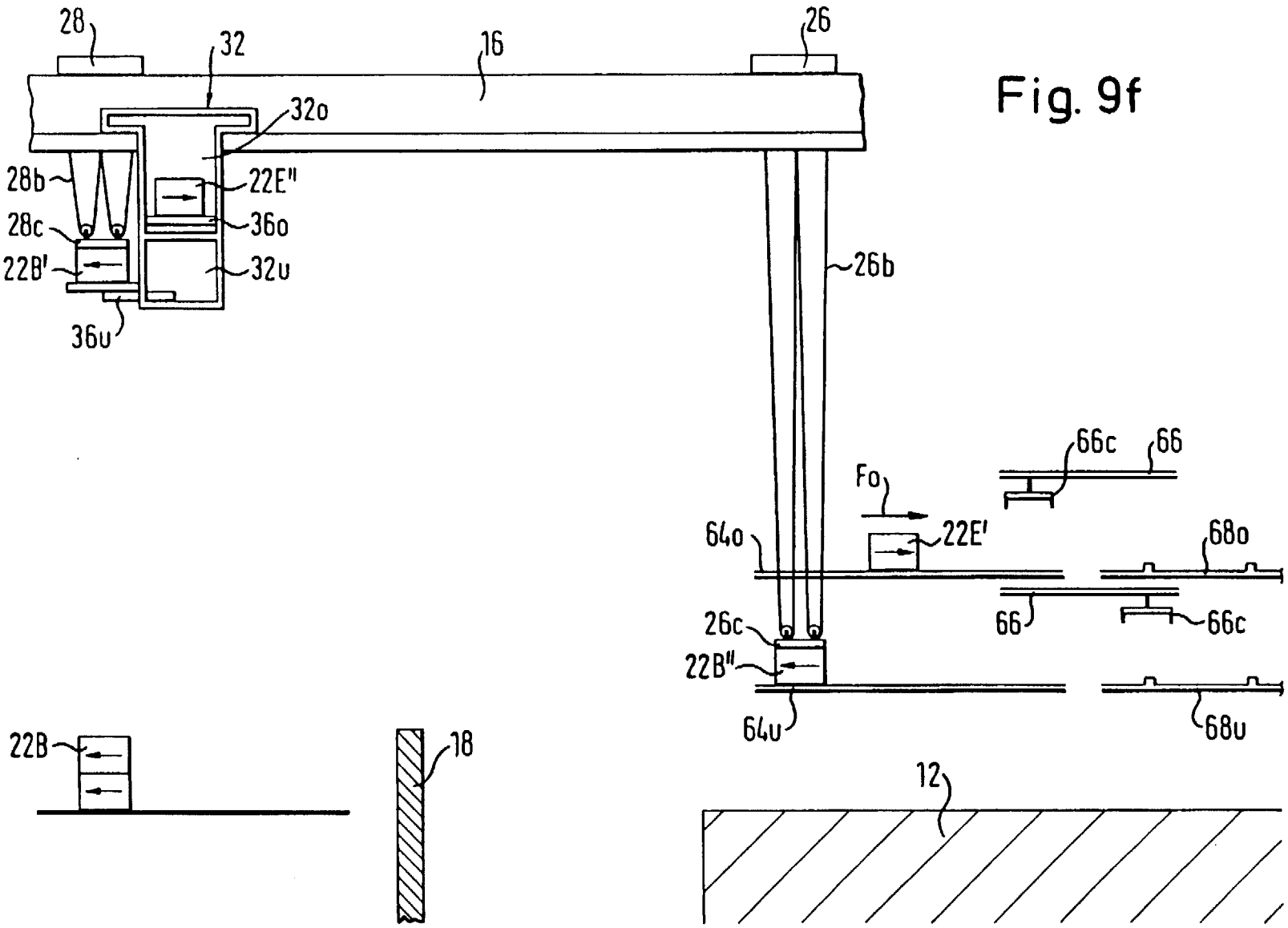

In FIG. 9f, the spreader 26c of the shore crab 26 is coupled to the load container 22B". The spreader 28c of the sea crab 28 is released from the unload container 22E" and the unload container 22E" brought by means of the upper operating device 36o in to the upper pick-up region 32o of the transfer crab 32. The load container 22B' thereupon is moved out of the lower pick-up region 32u by means of the lower operating device 36*u* and the spreader 28*c* is lowered and coupled to the load container 22B'. The transfer crab 32 and sea crab 28 meanwhile have ended their joint shift and the lower operating device 36*u* is again brought in.

In the meantime, the unload container 22E' is conveyed by the upper conveyor track 64*o* to the upper delivery device 66 (arrow Fo).

The double-cycle loading and unloading operation described above is repeated until the container ship 18 has been completely unloaded and simultaneously loaded. In this connection, whenever an unload container stack 20 has been completely removed from the container ship 18, the sea crab 28 and transfer crab 32 do not execute a joint shift, so that filling of the resulting vacancies with load containers can be begun promptly.

Figure 4:
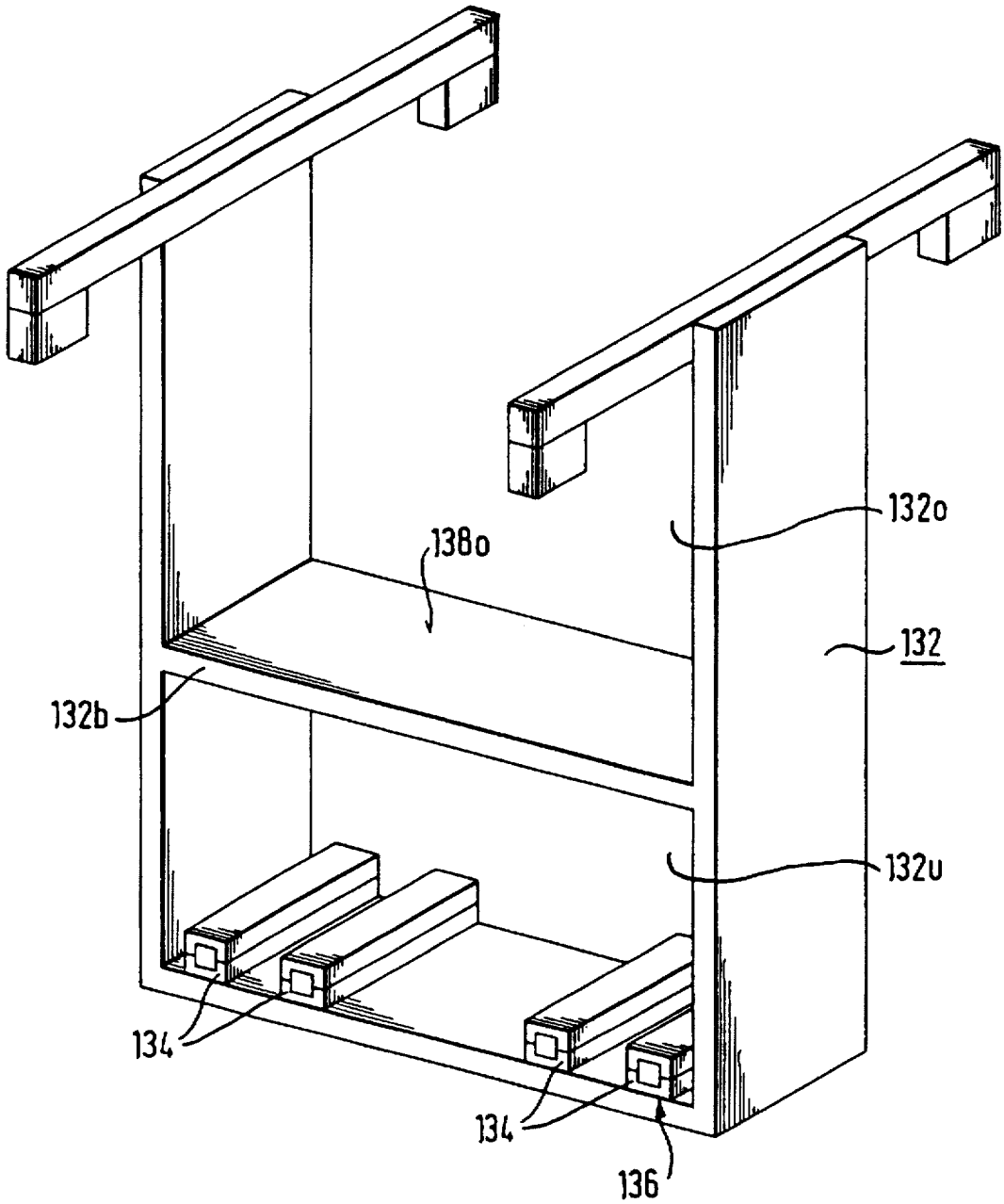
FIG. 4, a view similar to that of FIG. 3*a* of a second embodiment of a transfer unit.

A second embodiment of a transfer crab is represented in FIG. 4, where similar parts are provided with the same reference numerals as in FIGS. 1 to 3, but increased by the number 100.

Since the transfer crab and hoist crabs generally are designed so that the transfer crab can be moved past the hoist crab without interference only when the hoisting gears of the hoist crabs are substantially fully raised (cf. in particular FIG. 1*b*), it is possible to provide only the lower pick-up region 132*u* of the transfer crab 132 with an operating device 136 (in the present case in the form of telescoping forks 134). No operating devices are provided in the upper pick-up region 132*o*.

In this embodiment the delivery of containers into the upper pick-up region 132*o*can be made so that the transfer crab 132 is first moved directly under the respective hoist crab when the latter has lifted a container as far as possible. The container thereupon is lowered by means of the hoisting gear of the hoist crab until the lower edge of the container rests on the upper container set-down surface 138*o*, which is formed by the upper side of the upper connecting base 132*b*. After release and lifting of the spreader the transfer crab 132 can finally be moved away again with the container and the transfer crab 132 or the respective hoist crab can execute a shift of about one container width. For pick-up of a container from the upper pick-up region 138*o*the steps just described are correspondingly executed in reverse sequence.

In principle, the operation described above for the transfer crab 132 may alternatively be executed with the transfer crab 32 of FIG. 3*a*.

Figure 5A:
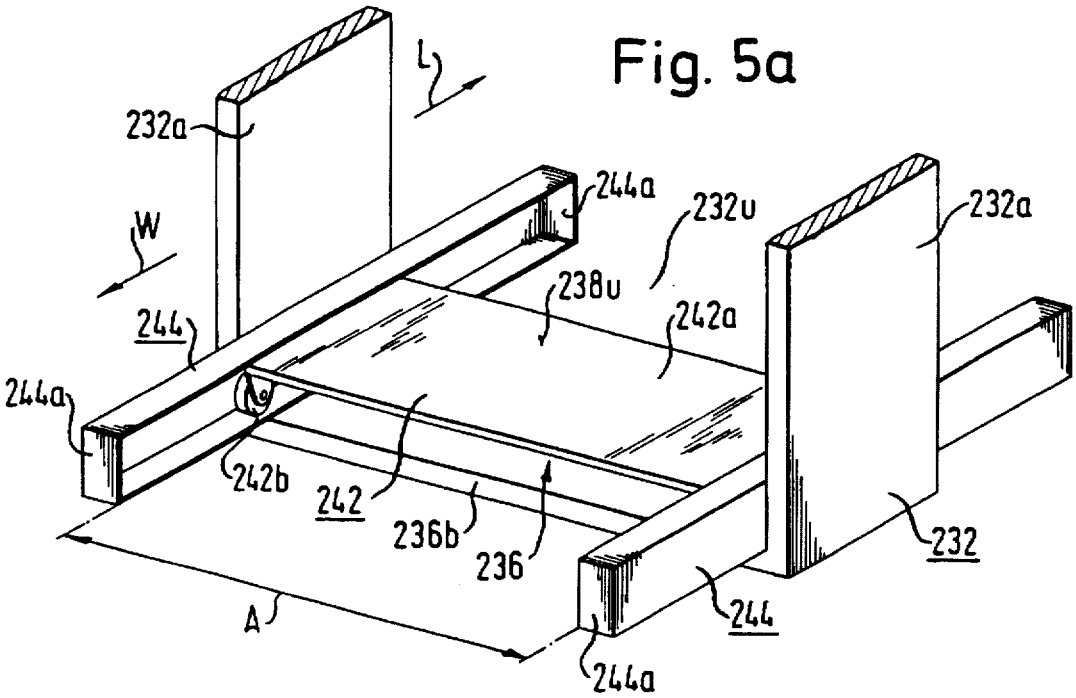
FIG. 5*a*, a partial perspective view of a third embodiment of a transfer unit.

A third embodiment of a transfer crab is represented in FIG. 5*a*, similar parts being provided with the same reference numerals as in FIGS. 1 to 3, but increased by the number 200.

The embodiment of FIG. 5*a* differs from the embodiments described above in the design of the operating device 236. The operating device 236 comprises a roller table 242 with a roller table plate 242*a* and rollers 242*b* mounted on its underside, of which only one is represented in FIG. 5*a*. The rollers 242*b* may be driven by a drive, not represented, for example, an electric motor. The operating device 235 additionally comprises two profile beams 244 having a substantially U-shaped cross section, which are attached to the transfer crab 232 so that the base arm of the U shape of each of the beams 244 rests on an assigned side wall 232*a* and one of the side arms of the U shape rests on the connecting base 232*b*, the open sides of the U shape being arranged turned toward one another. The roller table 242 is sized so that it engages in the beams 244 and the rollers 242*b* stand on the side arm resting on the connecting base 232*b*. So that the roller table 242 can be moved out of the transfer crab 232 on the seaward side (arrow W) and on the shore side (arrow L), the two beams 244 project beyond the side walls 232*a* of the transfer crab 232 on the seaward and shore sides. Here the length of the beams 244 is sized so that the roller table 242 can be moved out by one of the hoist crabs 26 or 28 into an operating position, for example the seaward operating position represented in FIG. 5*b*, for the exchange of containers. In order to prevent the roller table 242 from falling out of the beams 244, the latter are closed at both ends by means of sealing plates 244*a*. FIG. 5*c* shows the transfer position of the roller table 242.

Figure 5B:
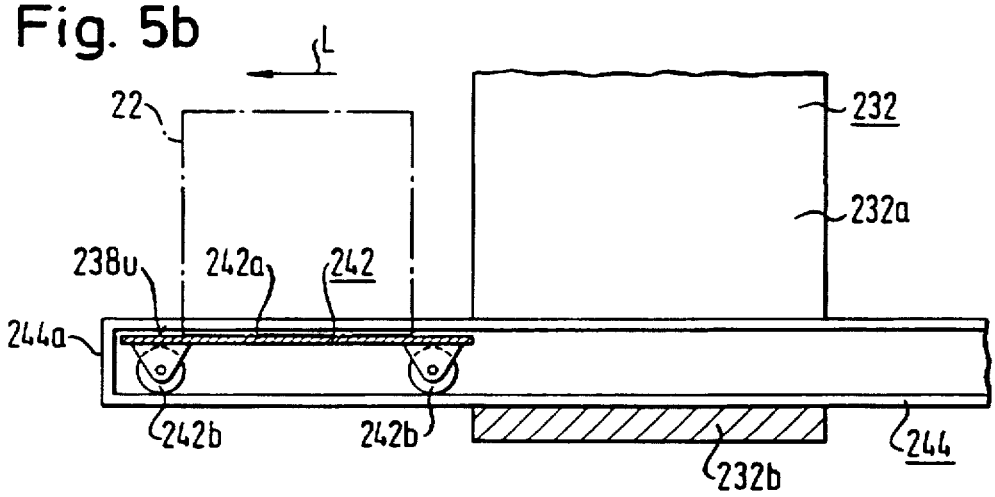
FIGS. 5*b* and 5*c*, sectional views taken along a center plane of the transfer unit of FIG. 5*a*, where the operating device is in the seaward operating position (FIG. 5*b*) and in the transfer position (FIG. 5*c*)
Figure 5C:
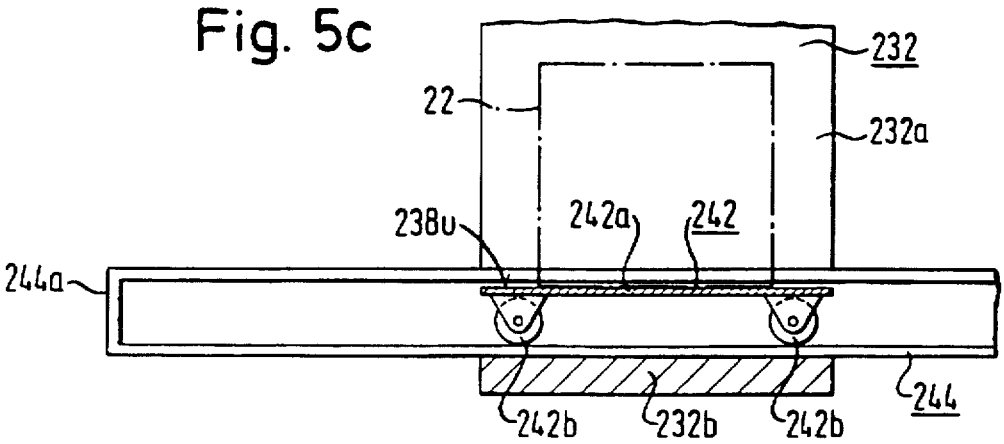

Although in FIGS. 5*a* to 5*c* the operating device 236 is represented as assigned to the lower pick-up region 232*u*, it may alternatively be used for operation of the upper pick-up region when the beams 244 are at a sufficient distance A apart (see FIG. 5*a*) for a container 22 with spreader 26*c* or 28*c* coupled to it to be moved through between them.

Figure 6A:
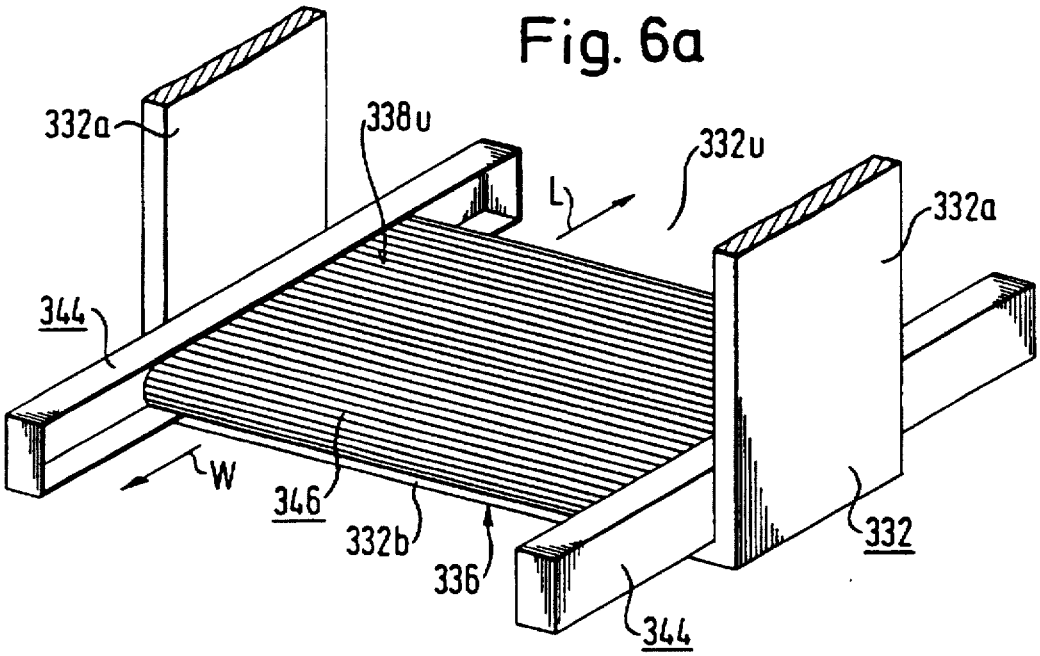
FIGS. 6*a* to 6*c*, views similar to those of FIGS. 5*a* to 5*c* of a fourth embodiment of a transfer unit.

A fourth embodiment of a transfer crab is represented in FIG. 6*a*, similar parts being provided with the same reference numerals as in FIGS. 1 to 3, but increased by the number 300.

The embodiment of FIG. 6*a* differs from the embodiment of FIG. 5*a* described above in that, instead of the roller table 242 a slat conveyor 346 engages movable in beams 344, which correspond to the beams 244 of FIG. 5*a*. According to FIG. 6*b*, the slat conveyor 346 comprises a guide member 346*a* with two drive rollers 346*b*, which may be driven by a drive, not represented, for example, an electric motor. The drive rollers 346*b* are arranged at narrow ends of the guide member 346*a*, spaced apart from one another, with axes running substantially parallel to one another, while the longitudinal ends of the drive rollers 346*b* engage in the beams 344. An endless belt 346*c* is stretched about the drive rollers 346*b* and the guide member 346*a*. The endless belt 346*c* consists of a plurality of individual plates 346*d* (FIG. 6*b*), whose dimension in the axial direction of the drive rollers 346*b* is substantially greater than their dimension transverse to this axial direction and which are joined together articulated.

Figure 6B:
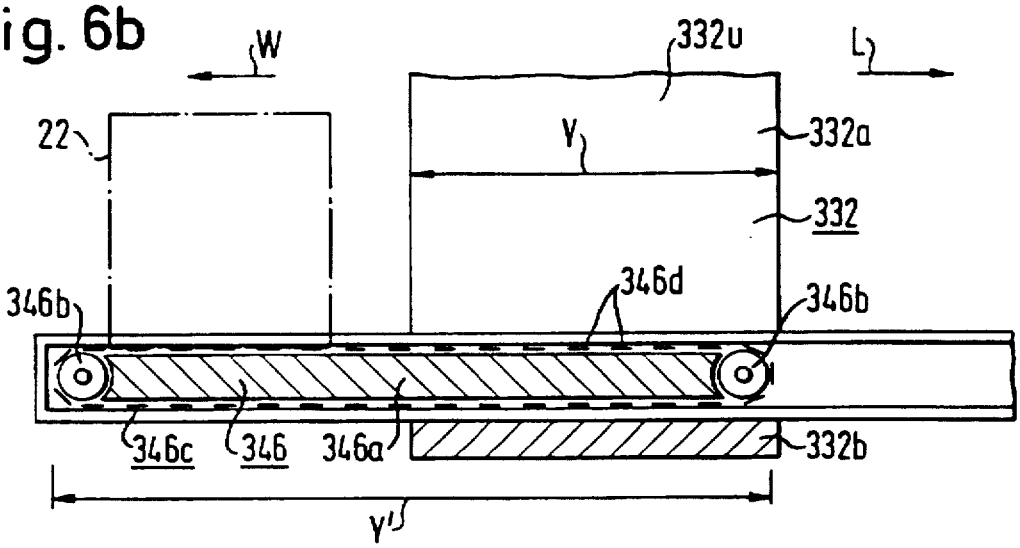
Figure 6C:
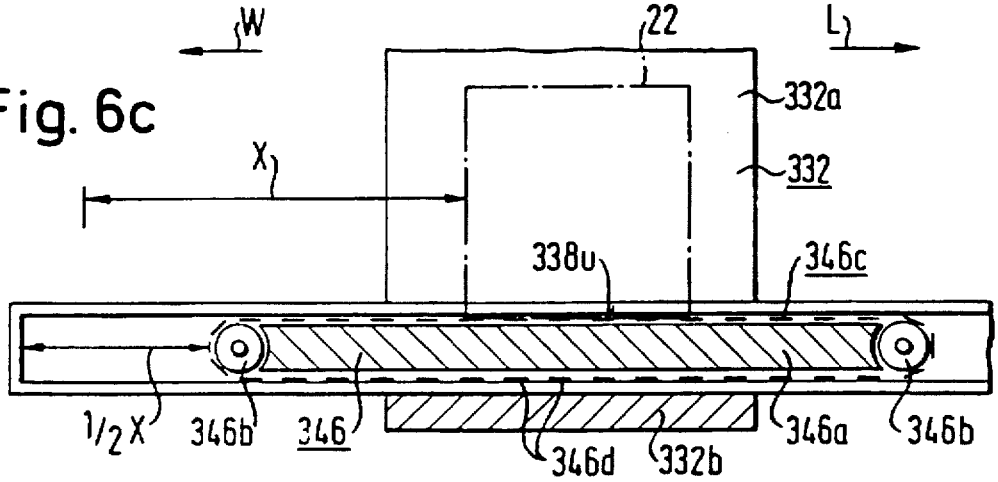

Because of the design of the slat conveyor 346 the guide member 346*a* of the slat conveyor 346 must be moved only the distance ½ X (see FIG. 6*c*) when the endless belt 346*c* is to be moved the distance X, in order to transfer a container 22 out of the seaward operating position of FIG. 6*b* into the transfer position of FIG. 6*c*. The same holds true for transfer between shore-side operating position and transfer position. Therefore the dimension Y' of the slat conveyor 346 in longitudinal direction of the beams 344 must be about twice as great as the dimension Y of the pick-up region 332*u* in this direction (cf. FIG. 6*b*). In its transfer position of FIG. 6*c*, the slat conveyor 346 thus projects from the respective pick-up region on the shore and seaward sides. Because of this projection the operating device 335 preferably is used only in the lower pick-up region 332*u*, although in principle it is possible to move a slat operating device assigned to the upper pick-up region into, for example, the seaward operating position (similar to FIG. 6*b*) when a container is to be supplied to or carried away from the lower pick-up region on the shore side.

It should be stated that the various embodiments of operating devices described above with the aid of FIGS. 3*a* to 6*c* may be combined with one another as desired. By way of example, let there be mentioned here only a transfer crab in which the upper pick-up region is equipped with a telescoping-fork operating device according to FIGS. 3*a* and 3*b* and the lower one with a roller-table operating device according to FIGS. 5*a* to 5*c*.

Figure 7B:
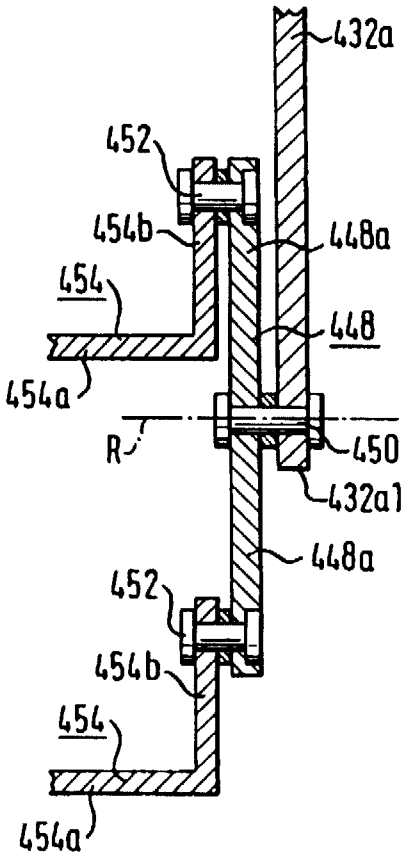
Figure 7A:
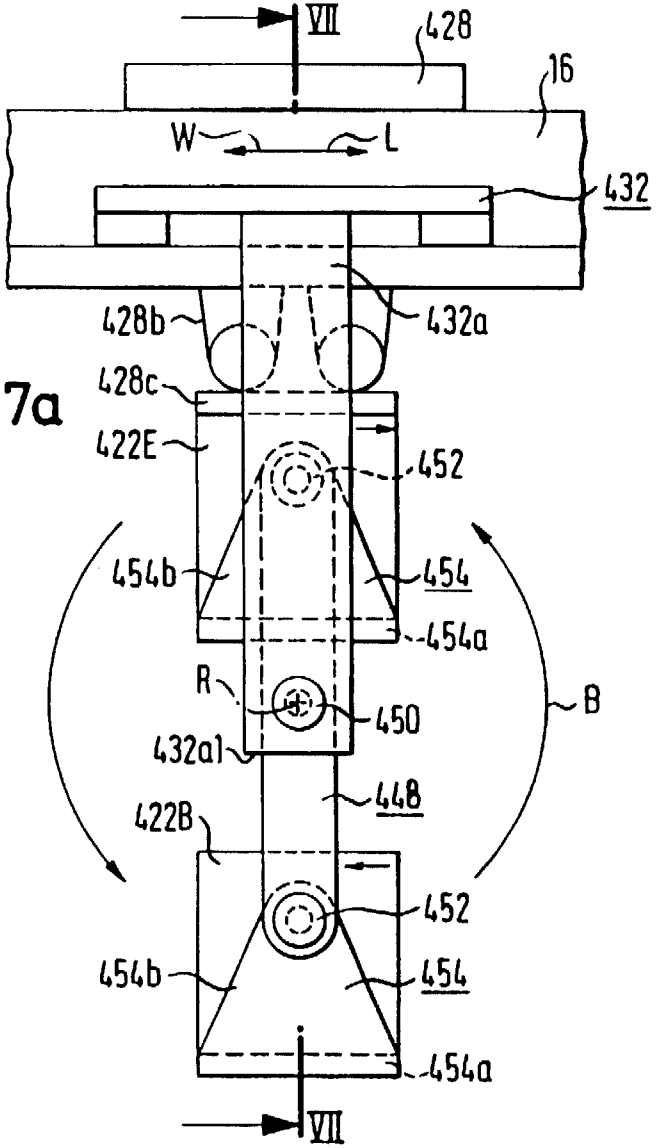
FIG. 7*a*, a side view of a fifth embodiment of a transfer unit.

A fifth embodiment of a transfer crab is represented in FIGS. 7*a* and 7*b*, similar parts being provided with the same reference numerals as in FIGS. 1 to 3, but increased by the number 400.

The transfer crab 432 comprises two side parts 432*a*, at whose lower ends 432*a* 1 an elongated swivel beam 448 is held rotatable, by means of a pivot pin 450, about a horizontal axis of rotation R (cf. FIG. 7*b*) running orthogonal to the direction of transfer (double arrow W/L). The pivot pin 450 penetrates the swivel beam 448 so that the latter is divided into two arms 448*a* of substantially equal length. Each of these arms 448*a* is penetrated, at its end turned away from the pivot pin 450, by an additional pivot pin 452, on which rocker units 454 are held rotatable about axes running substantially parallel to the axis of rotation R. Each of the rocker units 454 has a rocking base 454*a* and in addition two rocking side parts 454*b* for connection with the pivot pin 452. Additionally provided is a drive, not represented, by means of which the swivel beams 448 assigned to the two side parts 432*a* can be rotated (arrow B in FIG. 7*a*). As a result of this rotation the two rockers 454 are swung about the axis of rotation R in the manner of a Ferris wheel. The rockers 454 are designed so that their center of gravity, in the unloaded state as well as in the state loaded with a container, is located underneath the pivot axis fixed by the assigned pin 452. This ensures that the rockers 454 automatically maintain their orientation relative to the transfer crab 432.

When the transfer crab 432 described above is used, the exchange of a load container 422B and an unload container 422E between transfer crab 432 and sea crab 428 may be effected for example as explained below:

The transfer crab 432, on whose rocker 454, at this time lower, there is arranged a load container 422B received from the shore crab, not represented, is moved directly under the sea crab 428 which, by means of hoisting gear 428*b* and spreader 428*c*, has lifted an unload container 422E as far as possible. This unload container 422E is put down by the sea crab 428 on the now empty upper rocker 454. The swivel beam 448 thereupon is turned about the axis of rotation R by means of the drive, not represented, until the two rockers 454 have exchanged their positions. The rocker 454 carrying the load container 422B now is in the upper position and the rocker 454 carrying the unload container 422E is in the lower position, so that the sea crab 428 can receive the load container 422B from the now upper rocker 454. Lastly, the transfer crab 432 with the unload container 422E is again moved in the direction of the shore crab and the sea crab 428 lowers the load container 422B into the container ship. Cargo exchange with the shore crab is effected in corresponding fashion.

Figure 8A:
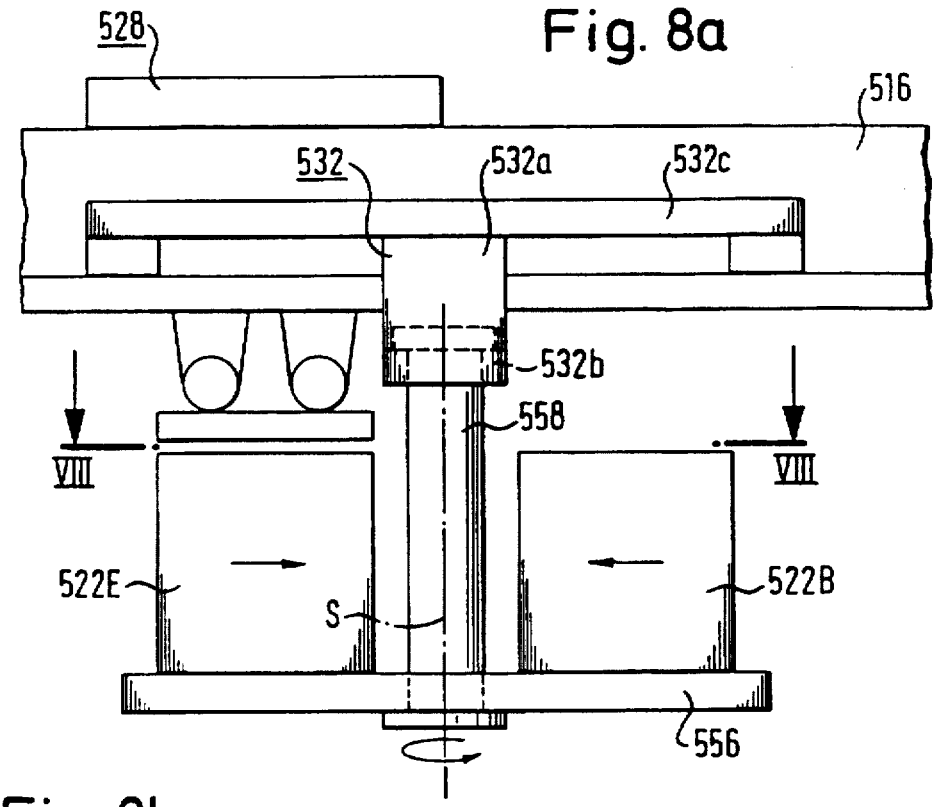
FIG. 8*a*, a side view of a sixth embodiment of a transfer unit.
Figure 8B:
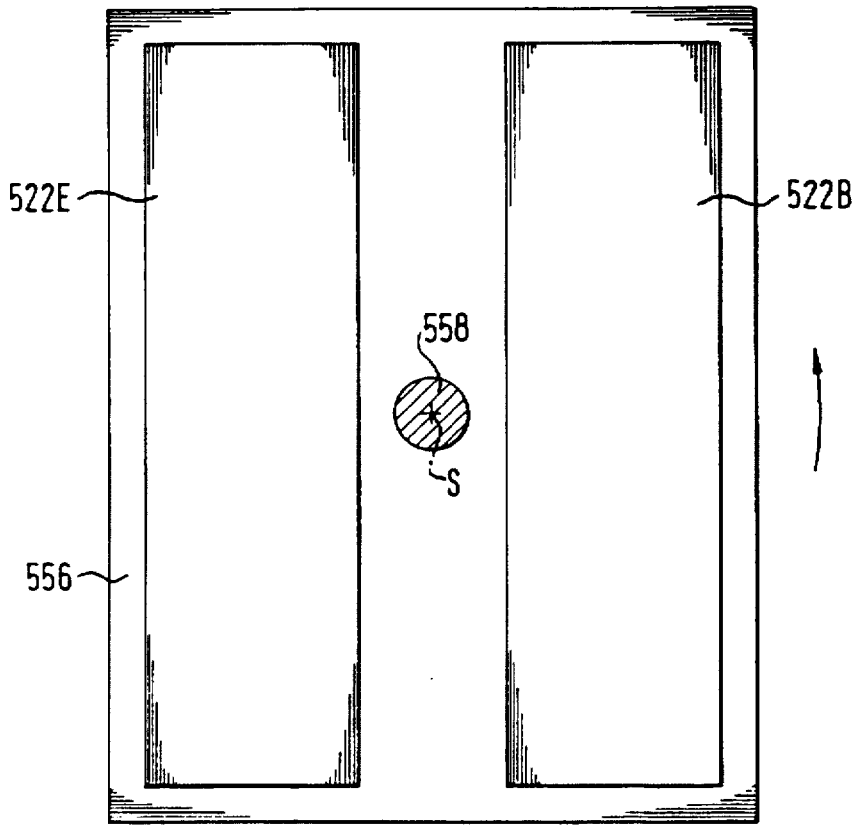
FIG. 8*b*, a sectional view of the transfer unit of FIG. 8*a* along the line VIII—VIII.

A sixth embodiment of a transfer crab is represented in FIGS. 8*a* and 8*b*, similar parts being provided with the same reference numerals as in FIGS. 1 to 3, but increased by the number 500.

The transfer crab 532 of FIG. 8*a* differs from the transfer crab of FIG. 7*a* in that the load container 522B and the unload container 522E do not exchange their positions as described above in the manner of a Ferris wheel by turning about an axis of rotation R running horizontally, but in the manner of a carousel by turning about a vertical axis of rotation S. To this end the transfer unit 532 is designed with a turntable 556, which is held rotatable about the axis S by an axle or shaft 558 of the connecting base 532*b* connecting the side parts 532*a* of the transfer crab 532. In order to ensure that the transfer crab 532 can be moved stably on the crane bridge 516 even when it is loaded with only one container, the carriage 532*c* of the transfer crab is designed especially long in the longitudinal direction of the crane bridge.

Receipt of the unload container 522E from the sea crab 528 and delivery of the load container 522B to the sea crab 528 are effected according to the procedure described above with the aid of FIGS. 7*a* and 7*b*, but with the difference that for exchange of position of the containers 522B and 522E the turntable 556 is now turned one-half rotation about the vertical axis of rotation S.

The design and function of a second example of a container loading crane are described below with the aid of FIGS. 10*a* to 10*e*, similar parts being provided with the same reference numerals as in FIGS. 1 to 3, but increased by the number 600. The conveyor means 664 is indicated only schematically in FIGS. 10*a* to 10 and, for the sake of clearer illustration, the transfer devices 66 and the transport means 68 are omitted. With regard to the steps concerning these parts, reference may be made to the description of FIGS. 9*a* to 9*f*.

Since the holds of container ships 618 are usually provided with separating walls 660 to increase the stability of adjacent container stacks 620, what has been said above, in particular with reference to FIGS. 9*a* to 9*f*, applies only to the loading and unloading of containers standing on deck. For the loading and unloading of containers standing between separating walls 660 it is necessary, before transfer travel after setting down the load container, first to lift the empty spreader over the upper edge of the separating wall 660 and then to lower it to the next unload container. This takes time. A further reduction in crane operating time may be obtained by use of the embodiment represented in FIGS. 10*a* to 10*e*. The container loading crane 610 differs from the container loading crane 10 of FIG. 1*a* in that the sea crab 628 is designed with two hoisting gears 628*b*1 and 628*b*2 with assigned spreaders 628*c*1 and 628*c*2.

Figure 10A:
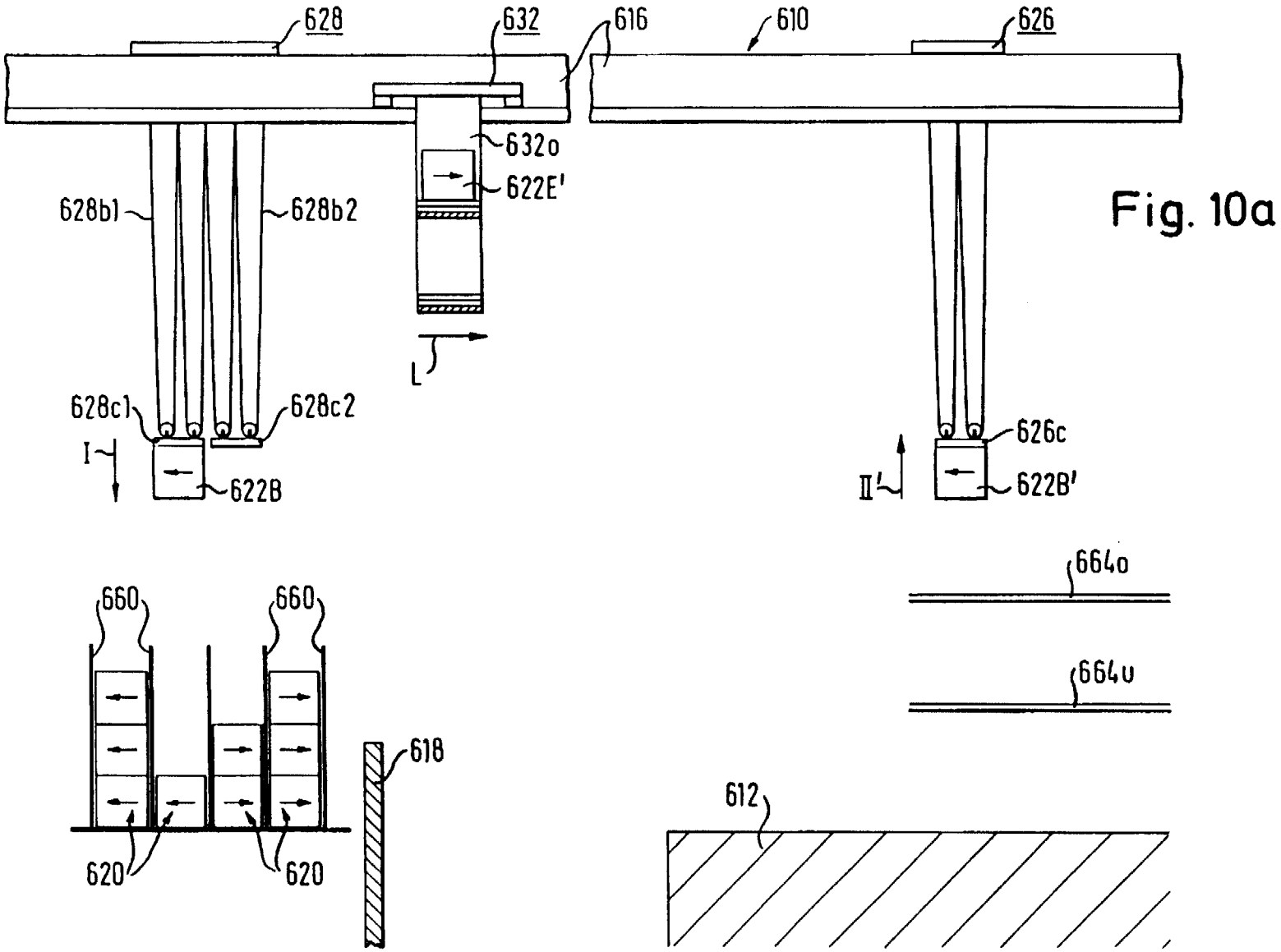
FIGS. 10*a* to 10*e*, schematic side views for the explanation of double-cycle operation in the region of the transfer unit of a second embodiment of the container loading crane.

In the following we start out from a situation such as represented in FIG. 10*a*. The sea crab 628 has just received from the transfer crab 632 a load container 622B with the spreader 628*c*1 and is in the process of lowering the two hoisting gears 628*b*1 and 628*b*2, which is indicated in FIG. 10*a* by an arrow I. In addition, the transfer crab 623 has received from the sea crab 628 an unload container 622E' in the upper pick-up region 632*o* and is on shore travel (arrow L in FIG. 10*a*). The shore crab 626 has taken from the lower conveyor means 664*u* a load container 622B' and is lifting it (arrow II' in FIG. 10*a*). An unload container previously put down by the shore crab 626 has already been transported away by means of the upper conveyor means 664*o*, the upper delivery device and the upper transport level.

Figure 10B:
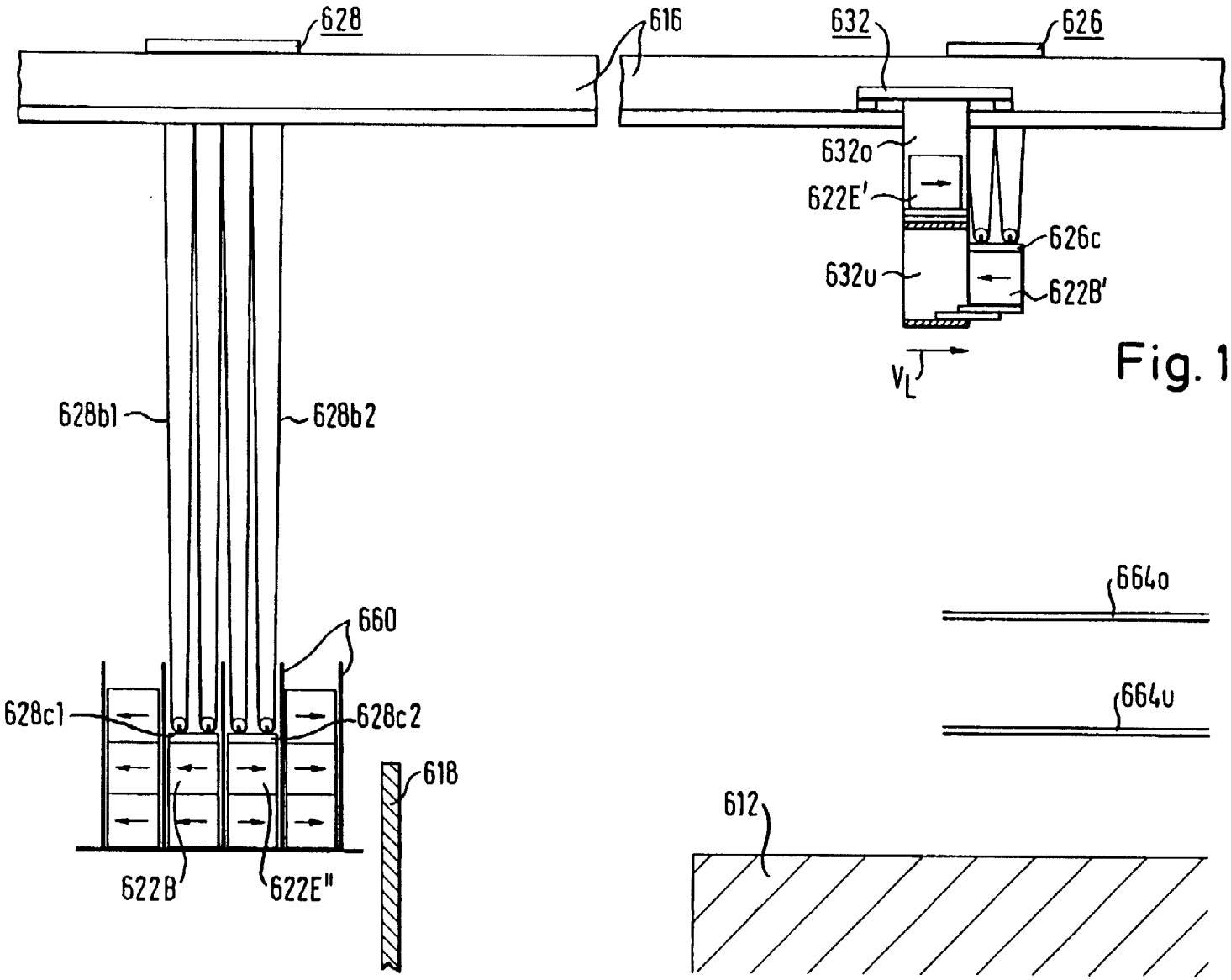
Figure 10C:
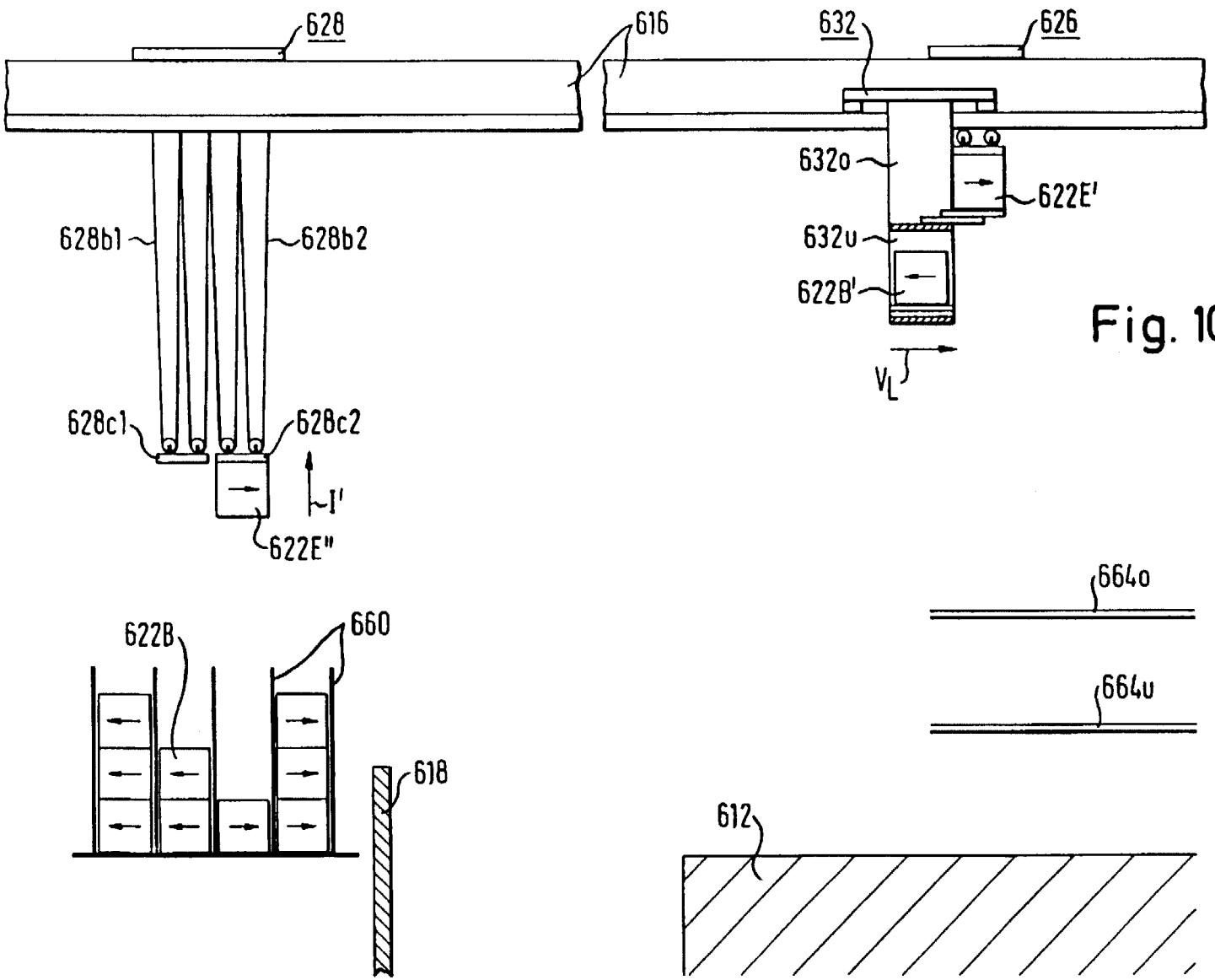

The exchange of containers 622E' and 622B' between shore crab 626 and the transfer crab 632, represented in FIGS. 10*b* and 10*c*, is effected in the same way as has been explained above for the container loading crane 10 with the aid of FIGS. 9*b* and 9*c*, to the description of which reference is made in this regard.

Meanwhile the sea crab 628 has unloaded the load container 622B on the container ship 618, released the spreader 628*c*1 and coupled the spreader 628*c* 2 to the next unload container 622E".

Figure 10D:
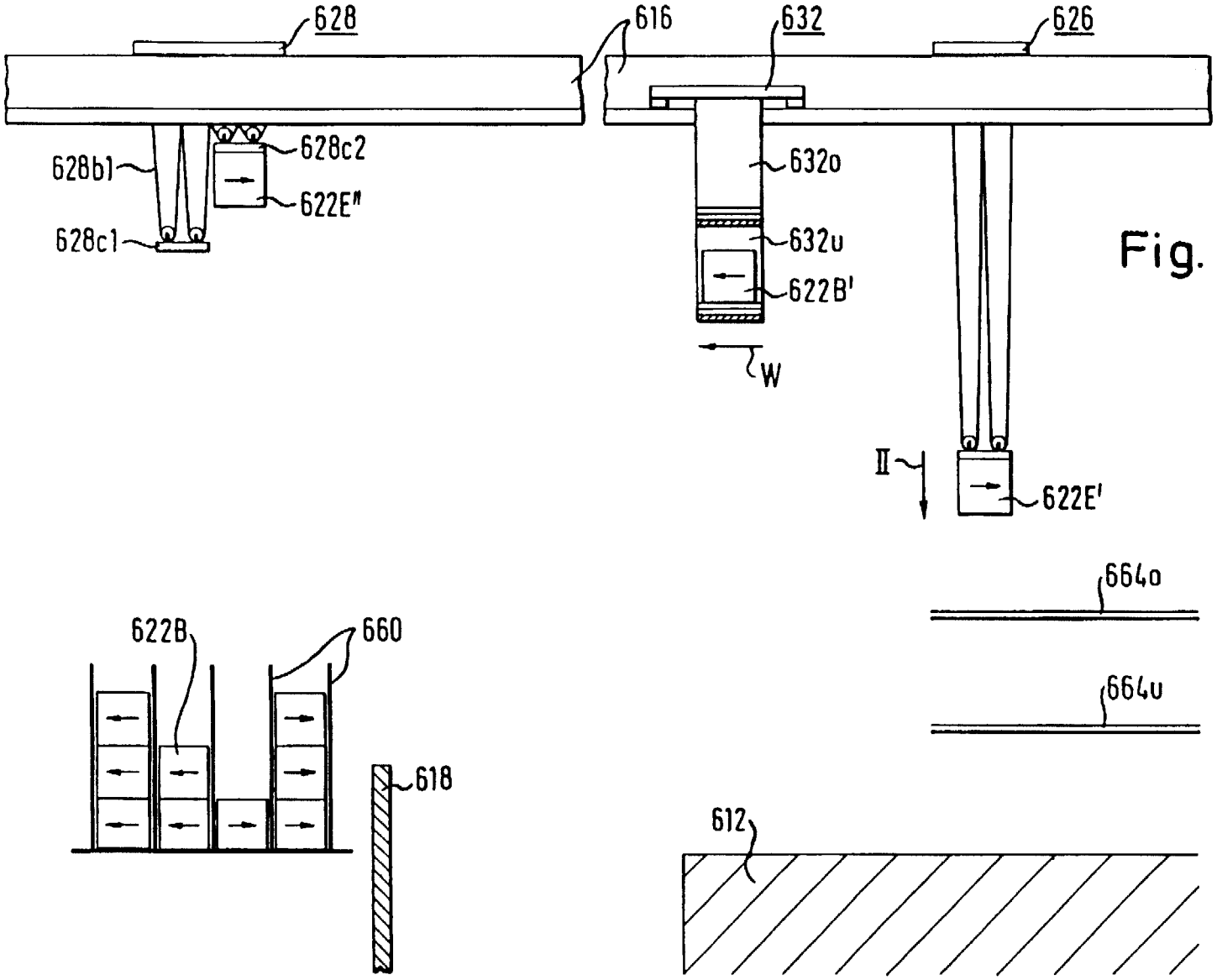

In FIG. 10*c*, the sea crab 628 is lifting the spreaders 628*c* 1 and 628*c* 2 and hence the unload container 622E" (arrow I'). Here the spreader 628*c* 2 with the unload container 622E" is raised as far as possible, whereas the spreader 628*c* 1 is raised only up to the height of the lower pick-up region 632*u*, as represented in FIG. 10*d*. In addition, in FIG. 10*d* the transfer crab 632 with the load container 622'B is on seaward travel (arrow W) and the shore crab 626 lowers the unload container 622E' (arrow II).

Figure 10E:
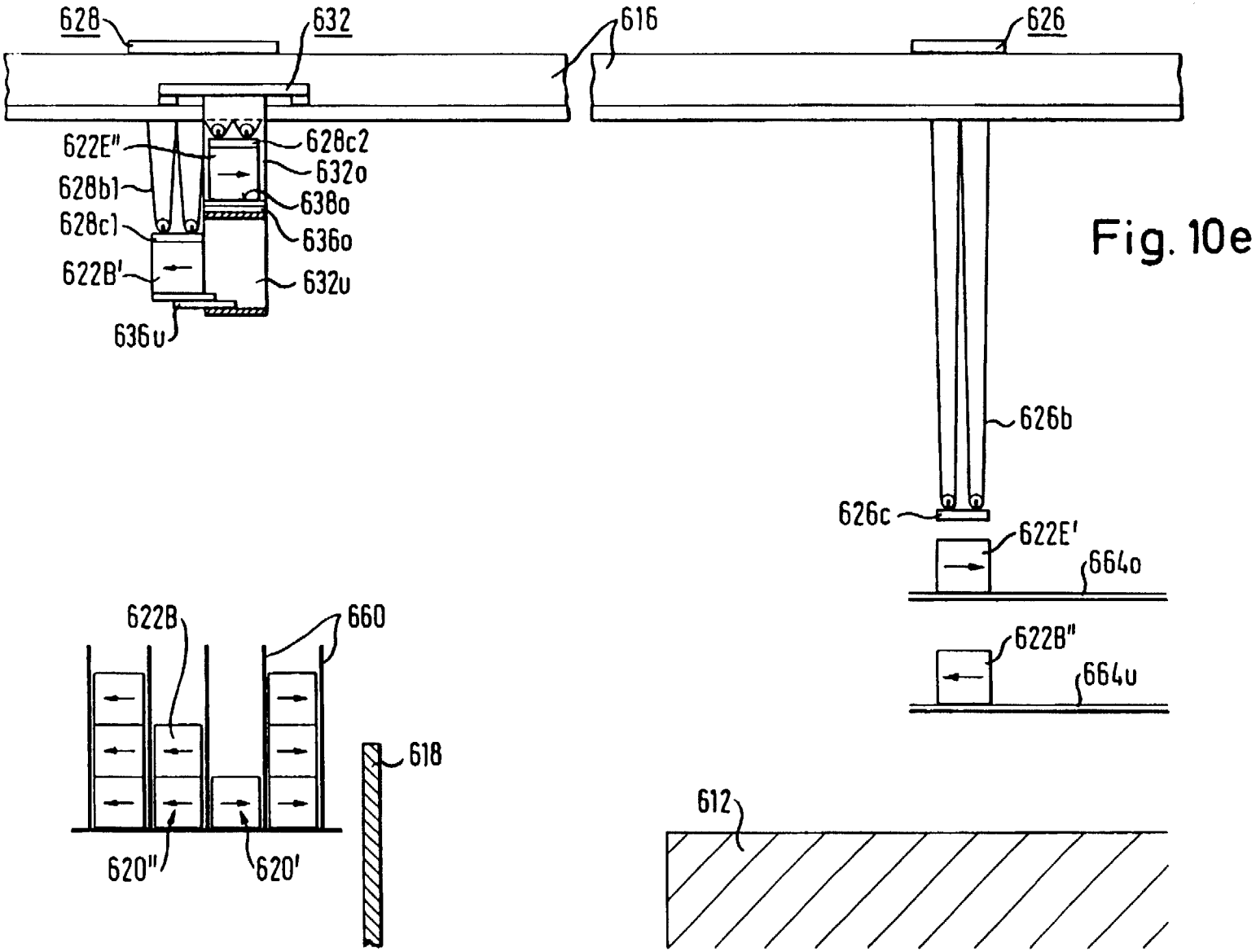

In FIG. 10*e* the transfer crab 632 is moved up to the sea crab 628 so that the unload container 622E' at the spreader 628*c*2 is already in the upper receiving region 632*o*. Therefore the unload container 622E' can be delivered simply by putting it down on the set-down surface 638*o* and releasing the spreader 628*c* 2 at the upper pick-up region 632*o* of the transfer crab 632, i.e., without moving the operating device 636*o* into the seaward operating position. Simultaneously with putting down the unload container 622E" the load container 622B' is transferred by means of the operating device 636*u* into the seaward operating position, in which it then is received by the sea crab 628 by coupling of the spreader 628*c*1. In this way the load container 622B' is already located directly over the container stack 620" on which the load container 622B was last put down, so that the sea crab 628 at the container loading crane 610 normally need not execute a shift.

Meanwhile the shore crab 626 has put the unload container 622E' down on the upper conveyor means 664*o*. The lower conveyor means 664*u* in the meantime has made the next load container 622B" available.

The double loading and unloading operating cycle described above is repeated until the container ship 618 has been completely unloaded and simultaneously loaded. Here the sea crab 628 must always execute a shift of one stack width when an unload container stack 620 on the container ship has been completely removed (in FIG. 10*e* this will next be the stack 620').

Figure 11:
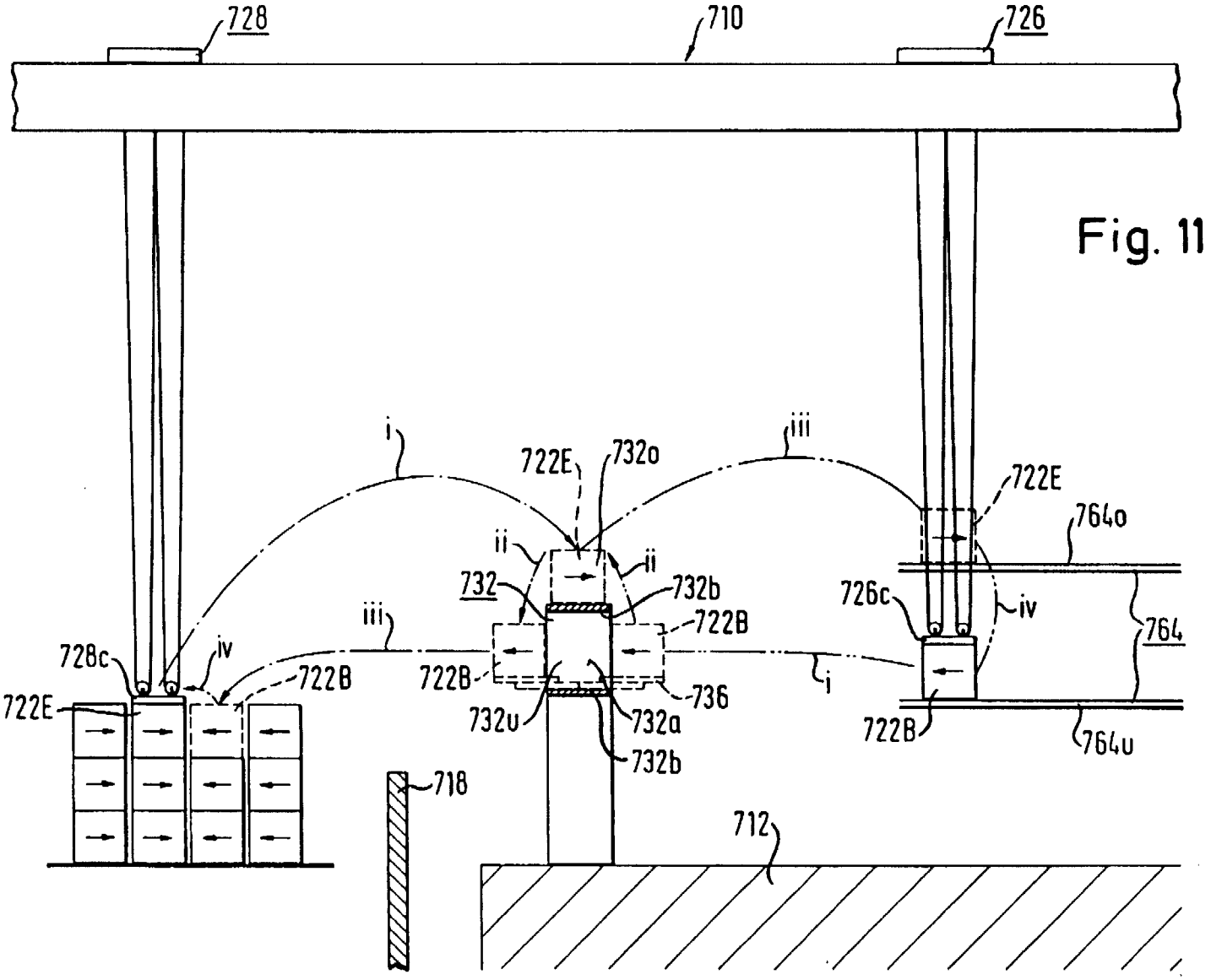
FIG. 11, a schematic side view for the explanation of double-cycle operation in the region of the transfer unit of another embodiment of the container loading crane.

The design and function of a third example of a container loading crane are described below with the aid of FIG. 11, where similar parts are provided with the same reference numerals as in FIGS. 1 to 3, but increased by the number 700.

The container loading crane 710 differs from the container loading crane 10 of FIG. 1*a* in that, instead of the transfer crab 32 movable along the crane bridge 16, a transfer unit 732 fixed on the dock 712 is arranged under the crane 710 and the shore crab 726 and the sea crab 728, in addition to lifting motions, also assume the function of horizontal transfer of containers to the conveyor means 764, indicated only schematically.

The transfer unit 732 has a lower pick-up region 732*u*, which is surrounded by two vertical side parts 732*a* and two horizontal connecting bases 732*b* and is equipped with an operating device 736. The operating device 736 may have any of the designs described above. The upper pick-up region 732*o* has only one base in the form of the upper connecting base 732*b*. The sea crab 728 and the shore crab 726 have the same design as the sea crab 28 and the shore crab 26 of the container loading crane of FIG. 1*a*.

Loading and unloading of containers in double-cycle operation is to be explained below for the container loading crane 710. In a first step the sea crab 728 picks up an unload container 722E and transports it to the transfer unit 732, where it puts it down in the upper pick-up region 732*o*, i.e., on the upper connecting base 732*b* (dash-dot line (i)). Meanwhile the shore crab 726 has picked up a load container 722B from the lower conveyor track 764*u* and set it down on the operating device 736 of the lower pick-up region 732*u* (dash-dot-dot line (i)), already moved out into the shore-side operating position.

In a subsequent second step the load container 722B is transferred by the operating device 736 from the shore-side operating position into the seaward operating position. The spreader 728*c* of the sea crab 728 is moved from the upper pick-up region 732*o* to the lower pick-up region 732*u*, where it picks up the load container 722B (dash-dot line (ii)) and the spreader 726*c* of the shore crab 726 is moved from the lower pick-up region 732*u* to the upper pick-up region 732*o*, where it picks up the unload container 722E (dash-dot-dot line (ii)).

In a third step the sea crab 728 transports the load container 722B to the container ship 718 and puts it down there (dash-dot line (iii)). At the same time the shore crab 726 transports the unload container 722E to the upper conveyor track 764*o* and puts it down there (dash-dot-dot line (iii)).

In a fourth and last step of the operating cycle the sea crab 728 executes a shift of about one stack width, in order to pick up the next container from the ship 718 (dash-dot line (iv)), while the shore crab 726 is lowered from the upper conveyor track 764*o* to the lower conveyor track 764*u* (dash-dot-dot line (iv)).

Described below with reference to FIGS. 12*a* to 12*d* are the design and function of a third example of a container loading crane by means of which loading and unloading of a container ship in double-cycle operation is likewise possible. In FIGS. 12*a* to 12*d* similar parts are provided with the same reference numerals as in FIGS. 1 to 3, but increased by the number 800.

The container loading crane 810 differs from the container loading crane 10 of FIG. 1*a* in that the sea crab 828 as well as the shore crab 826 are equipped with two hoisting gears 828*b* 1 and 828*b* 2 and 826*b* 1 and 826*b* 2 and, in addition, the transfer crab 832 has only one pick-up region 832*s*. The distance of the container set-down surface 838 of the pick-up region 832*s* from the crane bridge 816 is sized so that the transfer crab 832 loaded with a container can move through under a hoisting gear carrying a container, as is represented in particular in FIG. 12*b*.

Figure 12A:
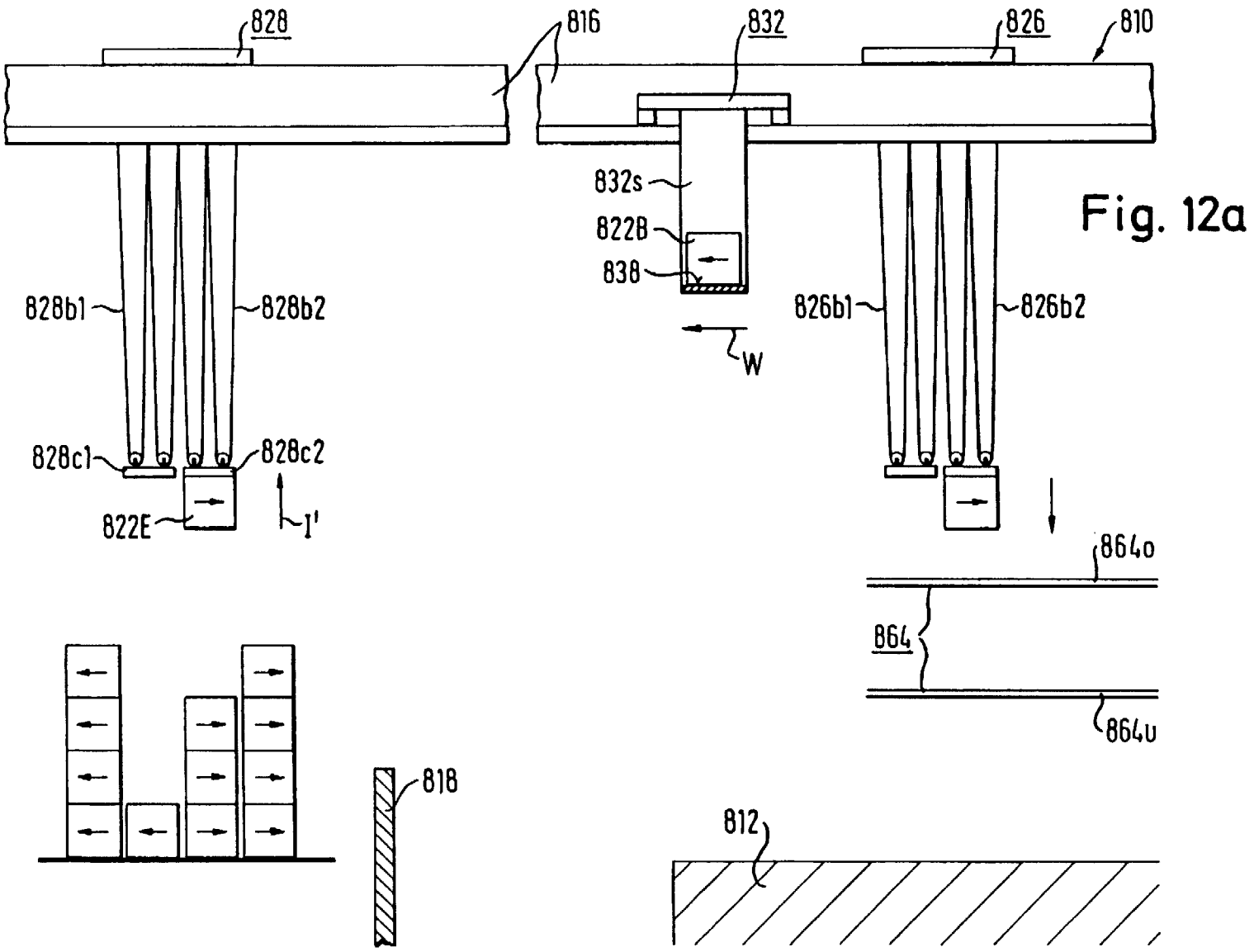
FIGS. 12*a* to 12*d*, schematic side views for the explanation of double-cycle operation in the region of the transfer unit of an additional embodiment of the container loading crane.

In FIG. 12*a* the conveyor means 864 is represented only schematically and, for the sake of clarity, the transfer means and the transport means are not represented at all.

Receipt of a load container 822B from the transfer crab 832 and delivery of an unload container 822E to the transfer crab 832 are to be explained briefly below by the example of the sea crab 828.

In FIG. 12*a*, the transfer crab 832 has just received the load container 822B from the shore crab 826 and is on seaward travel to the sea crab 828 (arrow W). The sea crab 828 with its spreader 828*c* 2 has picked up the unload container 822E from the container ship 818 and is lifting it (arrow I').

Figure 12B:
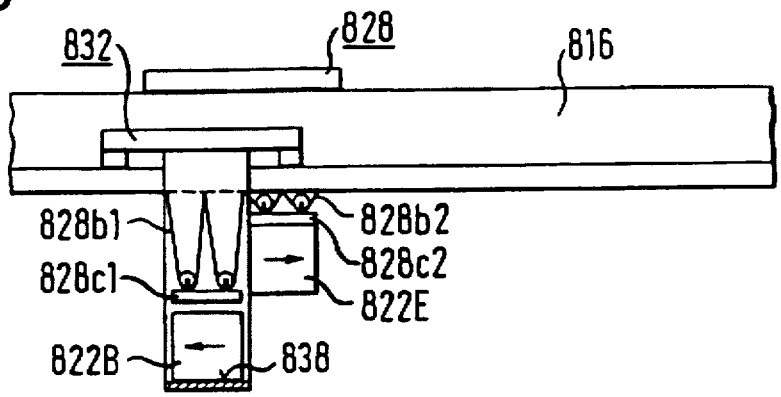

In FIG. 12*b* the sea crab 828 has raised the unload container 822E as far as possible, so that the transfer crab 832, loaded with the load container 822B, has been able to travel through under the hoisting gear 828*b* 2 to under the hoisting gear 828*b* 1. The spreader 828*c* 1 is lowered in order to receive the load container 822B from the transfer crab.

Figure 12C:
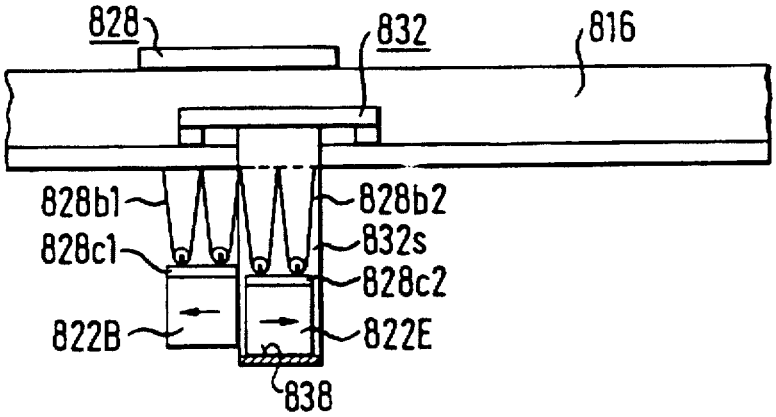
Figure 12D:
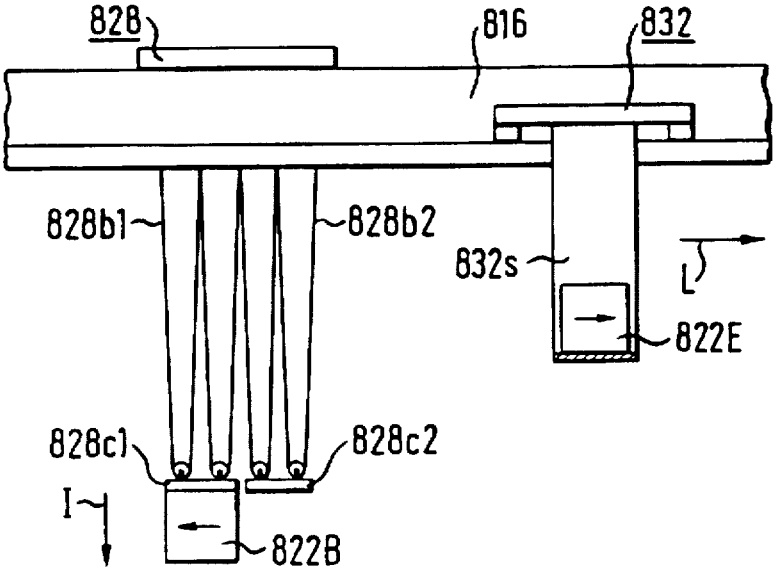

After this has taken place, the now empty transfer crab 832 of FIG. 12*c* is moved under the hoisting gear 828*b*2, so that the unload container 822E can be put down in the pick-up region 832*s*. The transfer crab 832 of FIG. 12*d* with the unload container 822E thereupon goes on shore travel (arrow L) and the sea crab 828 lowers the load container 822B down to the ship (arrow I).

Delivery or receipt of load container 822B and unload container 822E between the transfer crab 832 and the shore crab 826 is effected in corresponding fashion and will therefore not be described in detail.

Figure 13:
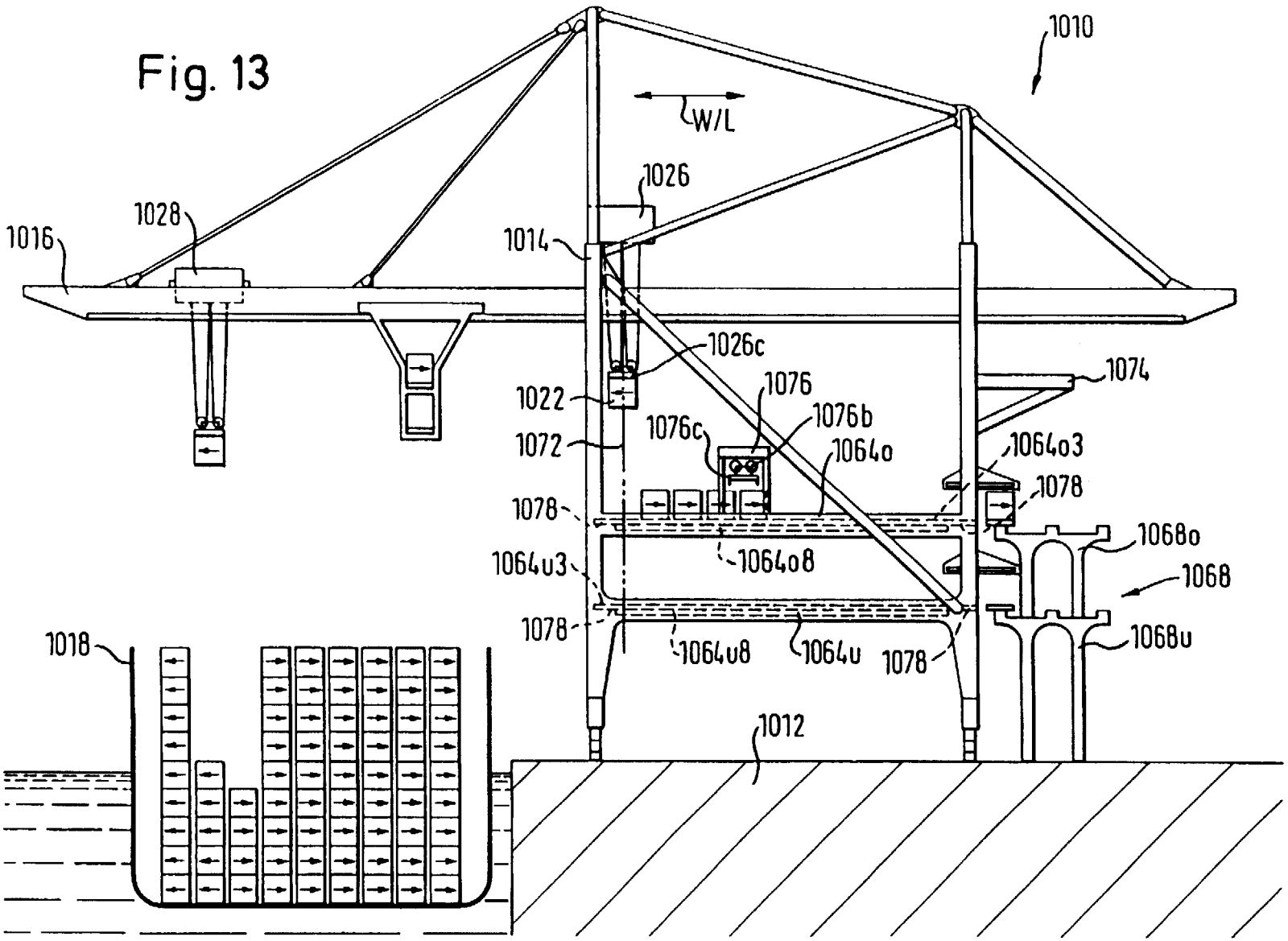
FIG. 13, a side view similar to that of FIG. 1*a* of an additional embodiment of a container loading crane in working position used in a shipping port.

The design and function of an additional embodiment of a container loading crane are described below with the aid of FIG. 13, where similar parts are provided with the same reference numerals as in FIGS. 1 to 3, but increased by the number 1000. In the following the container loading crane 1010 will be described only insofar as it differs from the container loading crane 10. Otherwise reference is made to the description of the latter.

The container loading crane 1010 differs from the container loading crane 10 of FIG. 1*a* in that, for one thing, instead of a shore crab (corresponding to the shore crab 26 of the embodiment of FIG. 1*a*) displaceable along the crane bridge 1016 in the direction of transfer (W/L), an elevator 1026 arranged fixed on the gantry 1014 is provided. This has the advantage that the sea crab 1028 can travel past the elevator 1026 without any problem, for example in order to place the hatchway cover present in container ships of an older design on a holder 1074 provided therefor on the gantry 1014.

The spreader 1026*c* of the elevator 1026 of the container loading crane 1010 is guided on its entire hoisting path between the crane bridge 1016 and the lower conveyor track 1064*u* by a guide device 1072 so that, even with strong winds, oscillation of the spreader 1026*c* and of the container 1022 held by the latter is prevented. The guide device 1072 is indicated schematically in FIG. 13 by a dash-dot-dot line.

The container loading crane 1010 additionally differs from the container loading crane 10 by the special design of the two conveyor tracks 1064*o* and 1064*u*, which in addition to the conveyor rails 1064*o*3 and 1064*u*3 alternatively have a return rail 1064*o*8 and 1064*u*8, which runs substantially parallel to the respective conveyor rail and serves for return of conveyor platforms from one end of the conveyor track to the other end of the conveyor track in each instance. For transferring conveyor platforms between the conveyor rail 1064*o*3 or 1064*u*3 and the associated return rail 1064*o*8 or 1064*u*8, transfer devices 1078 are provided at either end of the conveyor tracks 1064*o* and 1064*u*.

Figure 14A:
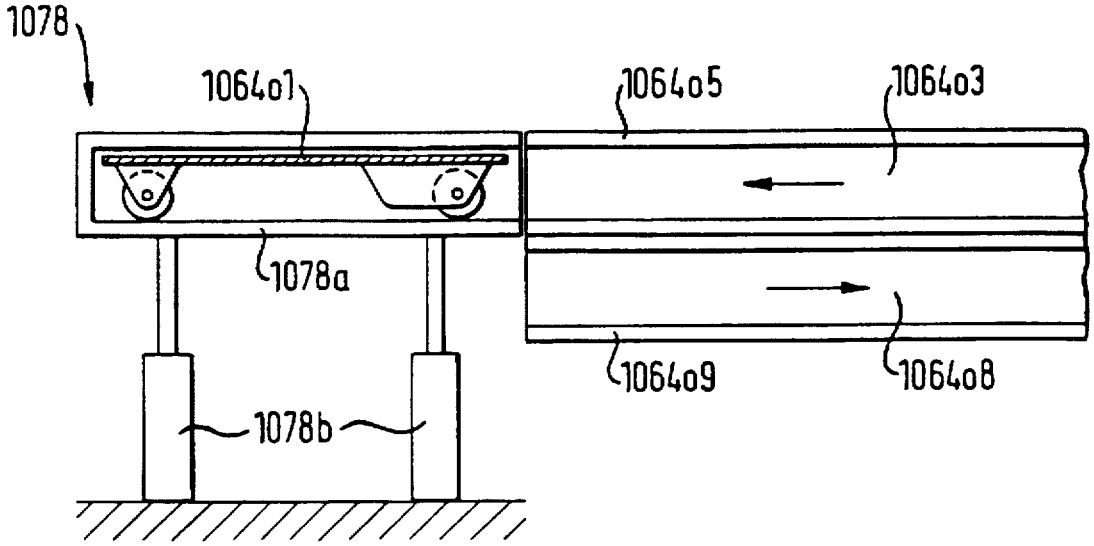
FIGS. 14*a* and 14*b*, side views of two operating positions of a transfer device of a conveyor track of the container loading crane of FIG. 13.
Figure 14B:
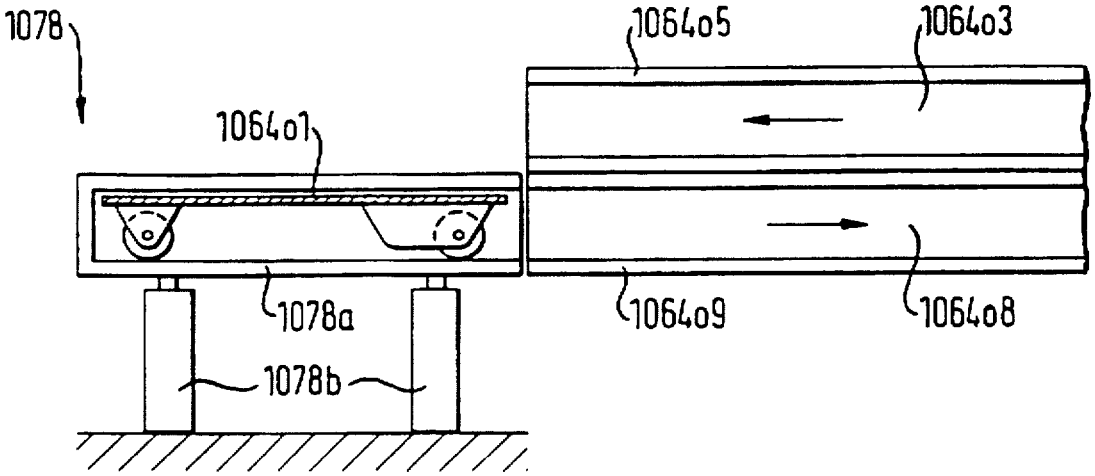

According to FIGS. 14*a* and 14*b*, the transfer devices 1078 comprise a beam section 1078*a* and an actuating device, for example two hydraulic cylinders 1078*b*. In the elongated position of the cylinder 1078*b* represented in FIG. 14*a*, the beam section 1078*a* is aligned with the beam 1064*o*5 of the conveyor rail 1064*o*3, whereas in the shortened position of the cylinder 1078*b* represented in FIG. 14*b* it is aligned with the beam 1064*o*9 of the return rail 1064*o*8. The transfer devices 1078 assigned to the lower conveyor track 1064*u* are designed correspondingly.

The design of the conveyor tracks 1064*o* and 1064*u* explained above permits the accommodation of a plurality of conveyor platforms in a conveyor track. Hence a corresponding plurality of containers can be accommodated in the conveyor track, which can thus at the same time alternatively assume, in addition to the conveying function, the function of a buffer for equalizing conveying rates of the container loading crane 1010 and the transport means 1068. In FIG. 13, for example, the removal of unload containers (small arrow to the right) has come to a halt, as a result of which four unload containers have already collected on the upper conveyor track 1064*o*. Because of the buffer function of the conveyor track 1064*o*, however, the container loading crane 1010 can continue loading and unloading the container ship 1018 without reducing the rate of loading, despite this buildup.

Lastly, the container loading crane 1010 differs from the container loading crane 10 in that in the region of the upper conveyor track 1064*o* there is provided a supplementary hoist means 1076 with a hoisting gear 1076*b* and a spreader 1076*c*, which can pick up load containers directly from the dock 1012 and, for example, set them on the lower conveyor track 1064*u* and/or put unload containers from the upper conveyor track 1064*o* down on the dock 1012.

This supplementary hoist means 1076 permits the performance of a special operation, for example, so that containers delivered at short notice can be taken directly from a truck driven under the container loading crane 1010 and fed into the load cycle. The same applies to a special unload operation. In addition, an emergency service in which the containers from the conveyor tracks can be put down on transport facilities standing under the crane 1010 or brought up from these transport facilities onto the conveyor tracks can be maintained in the event, for example, of breakdown of the transport means 1068. These transport facilities may for example be driverless transport means, so-called AGVs (automatic ground vehicles), semis with a plurality of trailers (so-called "trailer trains"), trucks or the like. Finally, it is possible to use the ground level of the dock 1012 as an expanded buffer in case of extensive congestion of the transport level 1068*o* or 1068*u* responsible for the removal of unload containers.

Cargo carriers, for example container ships, may be loaded and unloaded in time-saving double-cycle operation by all embodiments of the loading crane according to the invention described above and previously explained by the example of a container loading crane. In this connection, since according to the invention the operating-time advantages of a crane equipped with a plurality of crabs can be utilized simultaneously, a generally clearly increased loading and unloading rate is obtained, which in the examples described above is reflected in shorter lay times of vessels, with corresponding cost savings for shipowners.

The design and function of an additional example of a container loading crane are described below with the aid of FIGS. 15*a* to 15*d*. In FIGS. 15*a* to 15*d* similar parts are provided with the same reference numerals as in FIGS. 1 to 3, but increased by the number 900.

The container loading crane 910 differs from the container loading crane 10 of FIG. 1*b* in that the transfer crab 932 has only one pick-up region 932*s* and the conveyor means 964 only one conveyor track 964*s*, which is indicated schematically in FIGS. 15*a* to 15*d*. Correspondingly, only one delivery device and one transport rail level are provided, but, for the sake of clarity, these are not represented.

The pick-up region 932*s* is equipped with an operating device 936*s*. Although the container loading crane 910 is usually employed in single-cycle operation, i.e., the container ship 918 is either loaded or unloaded, equipment of the pick-up region 932*s* with the operating device 936*s* provides distinct time advantages as compared with a conventional container loading crane whose single pick-up region is not provided with an operating device. This will be explained below in detail, taking unloading of the container ship 918 in single-cycle operation as an example.

Figure 15A:
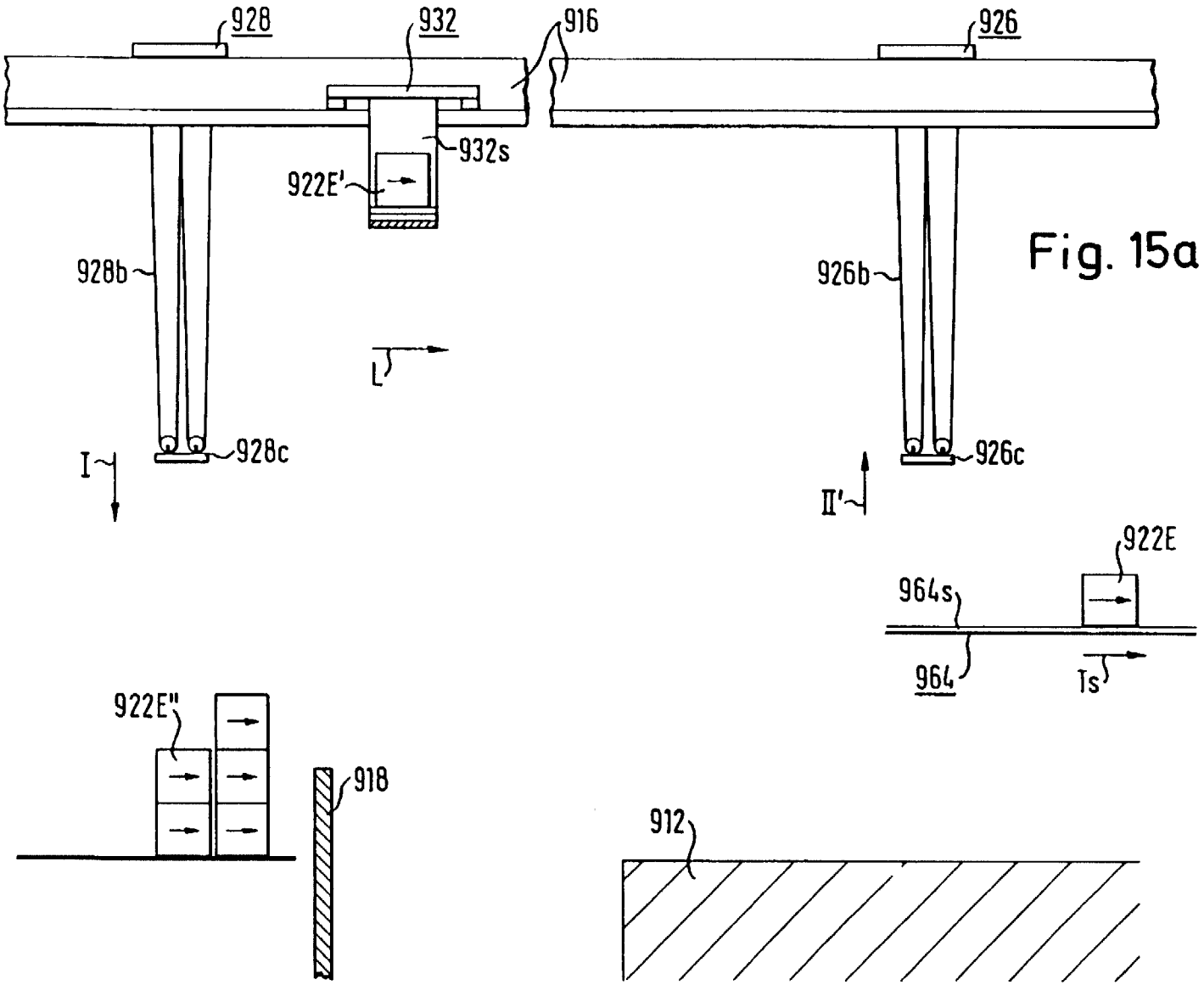
FIGS. 15*a* to 15*d*, schematic side views for the explanation of unloading operation in the region of the transfer unit of an additional embodiment of the container loading crane.

Here we start out from a situation as represented in FIG. 15*a*. The sea crab 928 has just delivered an unload container 922E' to the transfer crab 932 and is lowering its spreader 928*c* without container (arrow I) in order to pick up the next unload container 922E". The transfer crab 932 meanwhile is on shore travel with the unload container 922E' (arrow L). The shore crab 926 has put down the preceding unload container 922E on the conveyor track 964*s* and is just in the process of lifting its spreader 926*c* without container (arrow II'). Meanwhile the unload container 922E is conveyed from the conveyor track 964*s* to the delivery device (not represented) (arrow Ts).

As soon as the transfer crab 932 has reached the shore crab, it is interlocked with it. Lastly, when the spreader 926*c* of the shore crab 926 is in its highest position, the transfer crab 932 delivers the unload container 922E' to the shore crab 926. For this purpose, in FIG. 15*b* it moves the operating device 936*s* out on the shore side. The spreader 926*c* thereupon is lowered and coupled to the unload container 922E'.

Figure 15B:
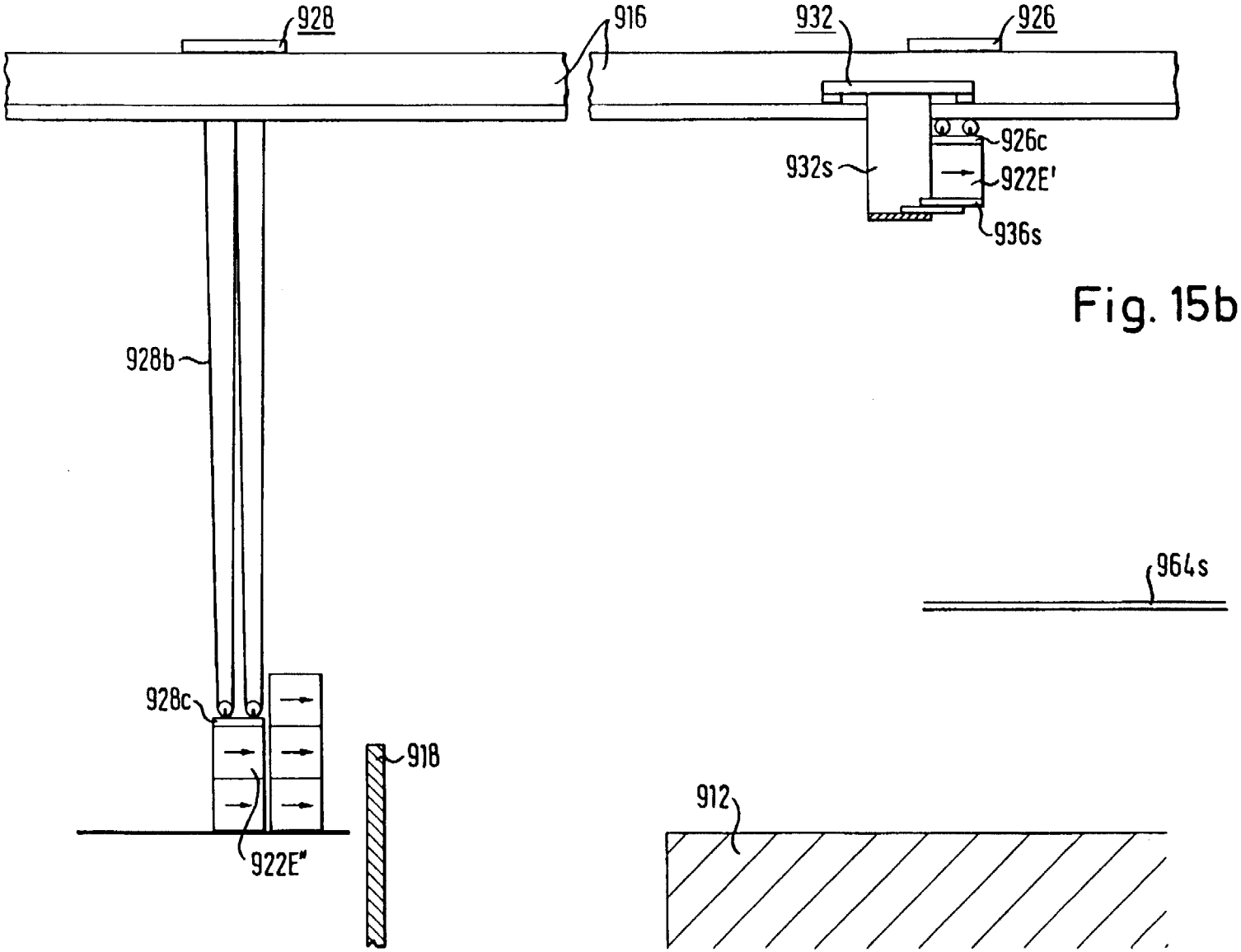
Figure 15C:
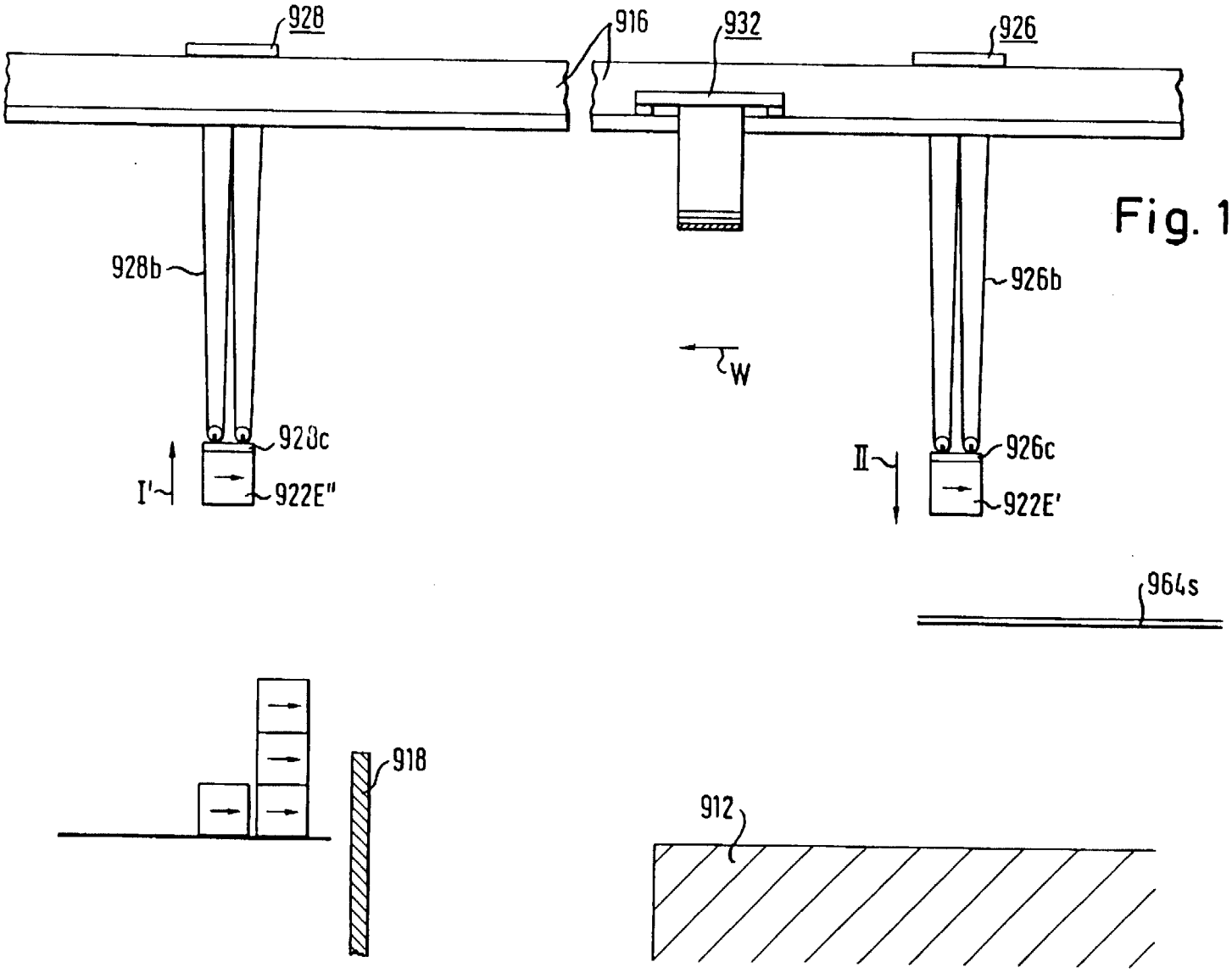

In FIG. 15*b* the sea crab 928 has coupled its spreader 928*c* to the next following unload container 922E' and in FIG. 15*c* lifts it upward (arrow I') by means of its hoisting gear 926*b*.

The shore crab 926 has lifted the unload container 922E' from the operating device 936*s*, so that the latter can be drawn into the transfer crab 932. Now the shore crab 926 of FIG. 15*c* lowers the unload container 922E' by means of its hoisting gear 926*b* (arrow II). Meanwhile the transfer crab 932, without container, is on seaward travel (arrow W). It is understood that the conveyor track 964*s* can be employed for loading as well as for unloading.

In a conventional transfer crab without operating device the steps last described take place as follows: Because of the saving in travel time for the transfer crab obtained by the conveyor means 964, the transfer crab reaches the shore crab before the latter has raised its spreader completely. Therefore the transfer crab must brake and wait until the spreader has been completely raised. The transfer crab then moves under the shore crab, so that the latter can pick up the unload container. However, so that the shore crab can then lower the unload container to the dock, the transfer crab must first have cleared the space under the shore crab.

To move the transfer crab under the shore crab, the great mass of the transfer crab, including the mass of the unload container, must be accelerated and braked again and, similarly, to clear the space under the shore crab, the mass of the transfer crab must first be accelerated. Accelerating this great mass requires a great deal of time on the one hand and, on the other, a great deal of energy.

In the container loading crane 910 according to the invention, the operating device 936*s* need only be moved out for delivery of the unload container 922E' and need only be drawn in again to clear the space under the shore crab 926. Consequently, the entire mass of the transfer crab need not be accelerated, but only the far smaller mass of the operating device. On the one hand, this requires less time and, on the other, it saves energy.

Figure 15D:
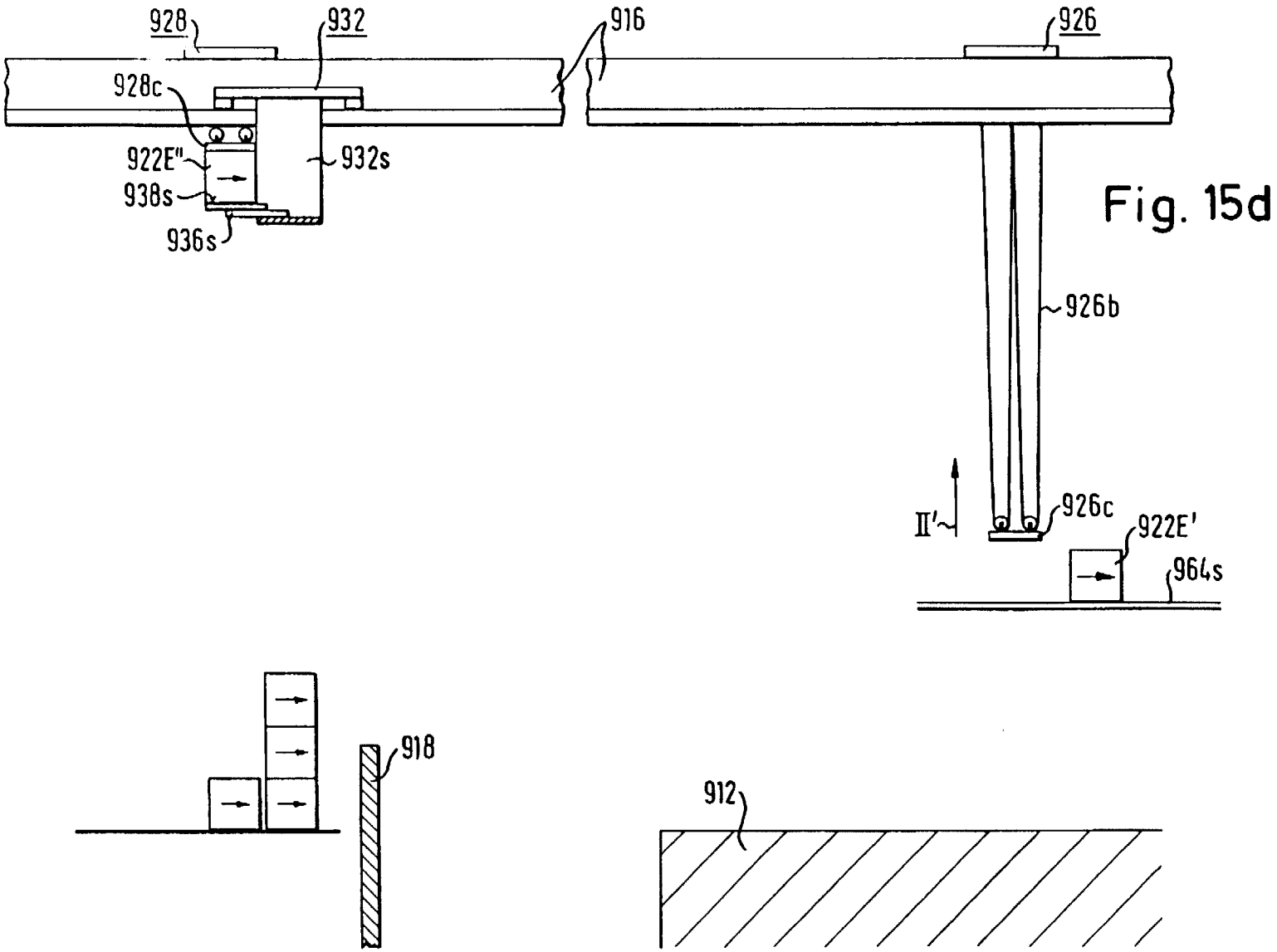

When the transfer crab 932 has reached the sea crab 928 of FIG. 15*d*, it is interlocked with the latter. When the spreader 928*c* of the sea crab 928, together with the unload container 922E", is in its highest position, the operating device 936*s* moves out on the seaward side. The spreader 928*c* thereupon puts the unload container 922E" down on the container set-down surface 938*s* and is uncoupled from it.

Meanwhile the shore crab 926 shortly before has put the unload container 922E' on the conveyor track 964*s* and is beginning to raise its spreader 926*c* in the direction of the arrow II'.

Again in the case of seaward container delivery, the container loading crane according to the invention saves both time and energy as compared with a conventional container loading crane.

In addition, equipment of the transfer crab with an operating device also has control advantages, since the movements of the transfer crab and the hoisting gear can be controlled separately, i.e., independently of one another. As described above, in the case of a conventional container loading crane the transfer crab must brake before the respective hoist crab, wait for the spreader to be fully raised and, lastly, move to exactly under the hoist crab, i.e., the movement of the transfer crab must be coordinated with the movement of the hoisting gear of the hoist crab. According to the invention, the transfer crab moves directly into its end position beside the hoist crab. When the hoisting gear has reached its end position, i.e., its highest position, the operating device is moved out upon a corresponding signal.

Attainment of the respective end positions may be indicated by the actuation of switches, arranged on the hoist crab, by the transfer crab and/or the hoisting gear. The operating device preferably is designed so that in its maximum moved-out state it has the required relative positioning for the hoisting gear of the hoist crab.

For loading the container ship 918 the steps described above are performed analogously in reverse sequence.

The time, energy and control advantages described above may alternatively be obtained with a transfer crab having two cargo pick-up regions, arranged one above the other, when both pick-up regions are equipped with an operating device, as is the case for example in the transfer crab 32 of FIG. 3*a*.

It should in addition be stated that use of the cargo loading crane according to the invention is not limited to the loading and unloading of container ships. Rather, it may be used to advantage everywhere where great quantities of unit loads are to be transferred in as short a time as possible.

It should further be stated that the number of conveyor tracks, as well as of transport rail levels, may be chosen at will as needed.

Although in the embodiments described above only the parking tracks 68*o*1 and 68*u*1 of the transport device 68 were operated by the delivery device 66, in principle it is alternatively possible to operate the accelerating and/or hold-up tracks or even the transport track of the transport device directly, by a correspondingly longer design of the delivery device.

We claim:

1. A cargo loading crane comprising:

a crane bridge extending in a direction of transfer, a first hoist unit, a second hoist unit spaced apart from the first hoist unit in the direction of transfer, the first hoist unit and the second hoist unit each having at least one hoisting gear that includes assigned cargo pick-up means, a transfer unit located between the hoist units and having means for transferring cargo selectively between the hoisting gear of the first and second hoist units, and a conveyor unit having a first load exchange area and a second load exchange area spaced apart from the first load exchange area in the direction of transfer, the second hoist unit having means for selectively releasing cargo to the conveyor unit and receiving cargo from the conveyor unit, the conveyor unit having means for selectively receiving cargo from the second hoist unit and releasing cargo to the second hoist unit and means for transporting cargo between the first load exchange area and the second load exchange area, and at least one delivery/receiving station for cargo associated with the second load exchange area.

2. A cargo loading crane according to claim 1, wherein the conveyor unit has at least two conveyor tracks, each having at least one delivery/receiving station for cargo.

3. A cargo loading crane according to claim 2, wherein the at least two conveyor tracks are arranged one above the other.

4. A cargo loading crane according to claim 2, wherein at least one of the conveyor tracks has at least one conveyor platform which is displaceable on rails extending in the direction of transfer.

5. A cargo loading crane according to claim 4, wherein the conveyor platform includes a fixed plate which, by means of rollers attached thereto, is movable on the rails.

6. A cargo loading crane according to claim 2, wherein the conveyor unit has a return track which runs substantially parallel to the conveyor track and serves for the return of conveyor platforms not loaded with cargo.

7. A cargo loading crane according to claim 6, wherein a transfer device is provided at both ends of each of the conveyor track and return track for the transfer of at least one conveyor platform from the conveyor track to the return track or vice versa.

8. A cargo loading crane according to claim 1, wherein the conveyor unit is mounted on a foundation supporting the cargo loading crane.

9. A cargo loading crane according to claim 8, wherein the cargo loading crane has a supplementary hoist unit enabling the exchange of cargo between the conveyor unit and the foundation supporting the cargo loading crane.

10. A cargo loading crane according to claim 9, wherein the supplementary hoist unit is displaceable in the direction of transfer.

11. A cargo loading crane according to claim 1, wherein the second hoist unit is displaceable in the direction of transfer.

12. A cargo loading crane according to claim 11, wherein the second hoist unit is displaceable in the direction of transfer on a transport track provided on the crane bridge.

13. A cargo loading crane according to claim 1, wherein the second hoist unit is nondisplaceable in the direction of transfer.

14. A cargo loading crane according to claim 13, wherein the second hoist unit is mounted on a frame of the cargo loading crane.

15. A cargo loading crane according to claim 1, and further comprising guide means located along a path of movement of the cargo pick-up means of the second hoist unit for facilitating the delivery of cargo from the second hoist unit to the conveyor unit and the pick-up of cargo by the second hoist unit from the conveyor unit.

16. A cargo loading crane according to claim 1, and further comprising vertical guide means for restricting swaying motions of the cargo pick-up means of the second hoist unit.

17. A cargo loading crane according to claim 1, and further comprising conveying transport means at the at least one delivery/receiving station for substantially continuously conveying cargo to the conveyor unit and for substantially continuously conveying cargo away from the conveyor unit.

18. A cargo loading crane according to claim 1, wherein the transfer unit has a cargo pick-up region with a cargo pick-up surface and an operating device by means of which the cargo pick-up surface, for the exchange of cargo with a front one of the hoist units, is displaceable in a forward direction between a transfer position and a front operating position and, for the exchange of cargo with a rear one of the hoist units, is displaceable in a backward direction between the transfer position and a rear operating position.

19. A cargo loading crane according to claim 1, wherein the transfer unit has at least two cargo pick-up regions, each having a cargo pick-up surface, wherein the cargo pick-up regions are arranged such that each of them can cooperate with each of the hoist units for the delivery of cargo from the hoist units to the cargo pick-up surface and for the receipt of cargo by the hoist units from the cargo pick-up surface.

20. A cargo loading crane according to claim 19, wherein at least one of the cargo pick-up regions has an operating device by means of which the cargo pick-up surface, for the exchange of cargo with a front one of the hoist units, is displaceable in a forward direction between a transfer position and a front operating position and, for the exchange of cargo with a rear one of the hoist units, is displaceable in a backward direction between the transfer position and a rear operating position.

21. A cargo loading crane according to claim 20, wherein the operating device has at least one extensible element with a base part fastened to the transfer unit and at least one telescoping part telescoping relative to the base part and displaceable in a forward direction and a backward direction.

22. A cargo loading crane according to claim 21, wherein the cargo pick-up surface is a surface of the telescoping part that faces away from the base part.

23. A cargo loading crane according to claim 22, wherein the two cargo pick-up regions are arranged one above the other, and at least the lower cargo pick-up region has an operating device.

24. A cargo loading crane according to claim 20, wherein the operating device has a platform which is adapted to move out on rails projecting from the pick-up region in a forward direction and a backward direction.

25. A cargo loading crane according to claim 24, wherein the platform is a plate having rollers fastened thereto so that the plate moves out on the rails, and the cargo pick-up surface is an upper surface of the plate disposed horizontally.

26. A cargo loading crane according to claim 24, wherein the platform includes an endless belt drawn about a guide member and roller elements so as to move out on the rails, and the cargo pick-up surface is an upper part of the endless belt disposed horizontally.

27. A cargo loading crane according to claim 19, wherein the two cargo pick-up surfaces are fixed relative to the assigned cargo pick-up regions and, relative to the transfer unit, are capable of jointly swinging about an axis running substantially horizontally, while maintaining their orientation relative to the transfer unit.

28. A cargo loading crane according to claim 19, wherein the two cargo pick-up surfaces are fixed on a substantially horizontal turntable that is adapted to rotate about a shaft running substantially vertically.

29. A cargo loading crane according to claim 1, wherein the transfer unit has a cargo pick-up region having a cargo pick-up surface and each of the hoist units has at least two hoisting gears, each with cargo pick-up means adapted to cooperate with the cargo pick-up region for the delivery of cargo to the cargo pick-up surface and for the receipt of cargo from the cargo pick-up surface, regardless of whether or not the other hoisting gear of the same hoist unit has picked up cargo.

30. A cargo loading crane according to claim 1, wherein the transfer unit is displaceable in the direction of transfer.

31. A cargo loading crane according to claims 30, wherein the transfer unit is displaceable in the direction of transfer on a transport track mounted on the crane bridge.

32. A cargo loading crane according to claim 1, wherein the transfer unit is nondisplaceable in the direction of transfer.

33. A cargo loading crane according to claim 32, wherein the transfer unit is fixed to the crane bridge.

34. A cargo loading crane according to claim 32, wherein the transfer unit is movable in a direction substantially orthogonal to the direction of transfer.

35. A cargo loading crane according to claim 32, wherein the transfer unit is fixed on a foundation supporting the cargo loading crane.

36. A method for the transport of cargo along a transfer direction between a first cargo set-down region and a second cargo set-down region spaced apart horizontally from the first cargo set-down region, comprising the steps of:

transporting cargo between the first cargo set-down region and a first position with the use of at least one first cargo pick-up and transport unit associated with the first cargo set-down region, transporting cargo from the first position to a second position with the use of at least one intermediate carrier unit, transporting cargo between the second position and a third position with the use of at least one second cargo pick-up and transport unit, transporting cargo between the third position and the second cargo set-down region with the use of a supplementary conveyor unit which conveys the cargo in the transfer direction, and at each of the first, second and third positions, transferring cargo between the unit by which cargo is transported to the respective position and the unit by which cargo is transported from the respective position.

* * * * *

UNITED STATES PATENT AND TRADEMARK OFFICE

CERTIFICATE OF CORRECTION

PATENT NO. : 5,775,866

DATED : July 7, 1998

INVENTOR(S) : Hans Tax, Dieter Bauer and Klaus Hösler

It is certified that error appears in the above-identified patent and that said Letters Patent is hereby corrected as shown below:

Col. 6, lines 19-20, delete the carriage return after "unit of" so that the sentence reads as follows:
--unit of FIG. 3*a* moved out in seaward operating position;--;
Col. 6, lines 35-36, sentence should read as follows:
--FIG. 7*b*, a partial sectional view of the transfer unit of FIG. 7*a* along the line VII-VII;--;
Col. 8, line 9, "track 640" should read --track 64*o*--;
Col. 9, the sentence bridging lines 34-35 should read in part as follows:
--end is visible in FIG. 2*c*, is again already--;
Col. 12, line 54, delete "In";
Col. 12, line 55, "FIG. 9e the load" should read --In FIG. 9e the load--;
Col. 13, line 30, "132*o*can" should read --132*o* can--;
Col. 13, line 41, "138*o*the" should read --138*o* the--.

Signed and Sealed this

Eighteenth Day of January, 2000

*Attest:*

Q. TODD DICKINSON

*Attesting Officer*

*Commissioner of Patents and Trademarks*